US006124798A

United States Patent [19]

Tai et al.

[11] Patent Number: 6,124,798

[45] Date of Patent: Sep. 26, 2000

[54] ALARM DEVICE DESIGNED TO WARN OF DANGER OF HITTING HIGH VOLTAGE POWER LINE BY CRANE IN MOTION

[75] Inventors: Chi-Fu Tai, Yung-Ho; Wen-Yuan Su, Taipei; Chang-Fa Yang, Hsin-Chuang; Chi-Jui Wu; Shih-Shong Yen, both of Taipei, all of Taiwan

[73] Assignee: Institute of Occupational Safety and Health, Council of Labor Affairs, Executive Yuan, Taipei, Taiwan

[21] Appl. No.: 09/208,254

[22] Filed: Dec. 9, 1998

[51] Int. Cl.[7] ..... G08B 21/00

[52] U.S. Cl. ..... 340/685; 340/539; 340/662

[58] Field of Search ..... 340/685, 686.6, 340/539, 662, 435

[56] References Cited

U.S. PATENT DOCUMENTS

| | | | |
|---|---|---|---|
| 3,745,549 | 7/1973 | Jepperson et al. | 340/685 X |
| 3,786,468 | 1/1974 | Moffitt | 340/660 X |
| 3,969,714 | 7/1976 | Greer | 340/685 X |
| 4,675,664 | 6/1987 | Cloutier et al. | 340/685 |
| 5,001,465 | 3/1991 | Siegel | 340/685 |
| 5,252,912 | 10/1993 | Merritt et al. | 340/903 X |

*Primary Examiner*—Thomas Mullen
*Attorney, Agent, or Firm*—Bacon & Thomas, PLLC

[57] ABSTRACT

An alarm device is designed to warn of danger of hitting high voltage overhead power lines by a crane in motion. The alarm device is composed of an electric-field sensor for detecting the alternating electric field of the overhead power lines and for outputting an alternating current, which is then converted or amplified by an amplifier connected with the electric-field sensor. An alternating voltage is outputted by the amplifier such that the alternating voltage is rectified and filtered by a rectifier/filter circuit connected with the amplifier. A direct current voltage output is brought about by the rectifier/filter circuit. A starter is disposed between the rectifier/filter circuit and a wireless transmitter capable of being activated by the starter to transmit a wireless signal at such time when the value of the direct current voltage exceeds a preset value. The alarm device is further composed of a wireless receiver/alarm for receiving the wireless signal and for effecting a warning signal.

4 Claims, 48 Drawing Sheets

ALARM DEVICE DESIGNED TO WARN OF DANGER OF HITTING HIGH VOLTAGE POWER LINE BY CRANE IN MOTION

FIELD OF THE INVENTION

The present invention relates to an alarm device which is intended to warn of danger of hitting high voltage power lines by a crane in motion.

BACKGROUND OF THE INVENTION

Power transmission is generally carried out by overhead power lines or underground cables which are generally confined to the metropolitan area. The overhead high voltage power lines located in or near a construction site are rather vulnerable to incidents in which the overhead high voltage power lines are damaged or hit by a crane in motion. Such an incident as described above may be fatal.

As shown in FIG. 1, a typical power line network consists of a voltage build-up transformer T1 for changing a power generating plant (G) voltage level of 13.8 kV or 20 kV to an ultrahigh voltage of 161 kV, which is then transmitted to the ultrahigh voltage load users via overhead power lines W1 supported by the overhead power line towers. In the meantime, the ultrahigh voltage power is transmitted to a primary power substation H1 in which the ultrahigh voltage level of 161 kV is reduced to a level of 69 kV for use by the special high voltage load users. The power is further transmitted via overhead power lines W2 to a secondary power substation H2 in which the power voltage is further lowered to a voltage level of 11.4 kV. The high voltage of 11.4 kV is distributed via distribution lines D1 to the high voltage users. In the meantime, the high voltage of 11.4 kV is changed by a transformer T2 (11.4 kV/110–220–380V), which is mounted on an overhead power line pole, to the lower voltage for household use.

It is very likely that a crane in motion may accidentally hit high voltage power lines located in or near the construction site. It is therefore conceivable that such an accident can be averted by an alarm device designed to warn of danger of hitting the overhead high voltage power lines by the crane in motion. The Japanese Industrial Safety Association disclosed an alarm device which is designed on the basis of the induced current of a grounded suspension arm or metal sphere. The induced current can be easily affected by the grounding situation of the crane. In addition, the induced portion and the connection line are rather lengthy such that they can be easily affected by the magnetic coupling.

SUMMARY OF THE INVENTION

It is therefore the primary objective of the present invention to provide an alarm device free from the drawbacks of the prior art alarm device described above. The alarm device of the present invention is designed to warn of danger of hitting overhead high voltage power lines by a crane in motion. The design of the alarm device of the present invention is based on the electric-field sensor technology and the radio technology.

The alarm device of the present invention consists of an electric-field sensor, an amplifier, a rectifier/filter circuit, a wireless transmitter, a starter, and a wireless receiver/alarm.

The electric-field sensor is used to detect the alternating electric field of high voltage power lines and to output a resulting alternating current which is then amplified by the amplifier that is connected with the electric-field sensor. The output of an alternating voltage is brought about by the amplifier. The rectifier/filter circuit is connected with the amplifier for rectifying and filtering the alternating voltage, thereby resulting in the output of a direct current voltage. The starter is disposed between the rectifier/filter circuit and the wireless transmitter for starting the wireless transmitter at such time when the direct current voltage exceeds a preset value. Upon being triggered by the starter, the wireless transmitter is activated to send out a radio signal, which is received by the wireless receiver/alarm to bring about a warning signal.

Preferably, the starter of the present invention comprises a memory capacitor for storing the preset voltage, and a comparator for comparing the direct current voltage with the preset voltage.

In addition, the alarm device of the present invention is provided with a set-up receiver for use in the remote control, and a relay for connecting the rectifier/filter circuit with the memory capacitor at the time when the set-up receiver receives a set-up signal, thereby resulting in a direct current voltage of the rectifier/filter circuit being sent to the memory capacitor in which the direct current voltage is stored as the preset voltage.

14, and the overhead power distribution lines of the three-phase four-wire (3ϕ4 w) type.

Figure 14:
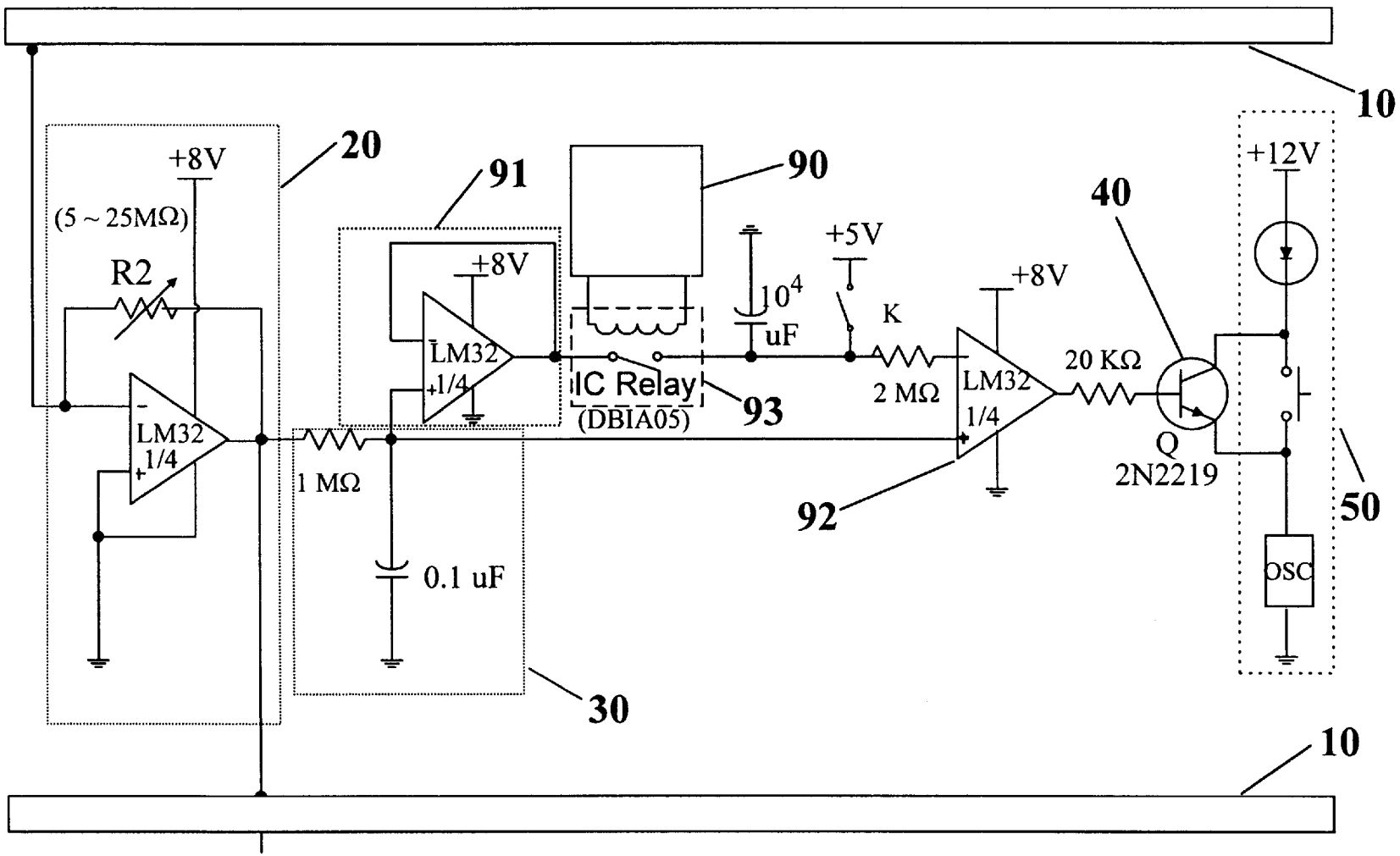
FIG. 14 shows a schematic view of a circuitry of a mean-value analog type remote setting alarm device of the present invention.
Figure 15:
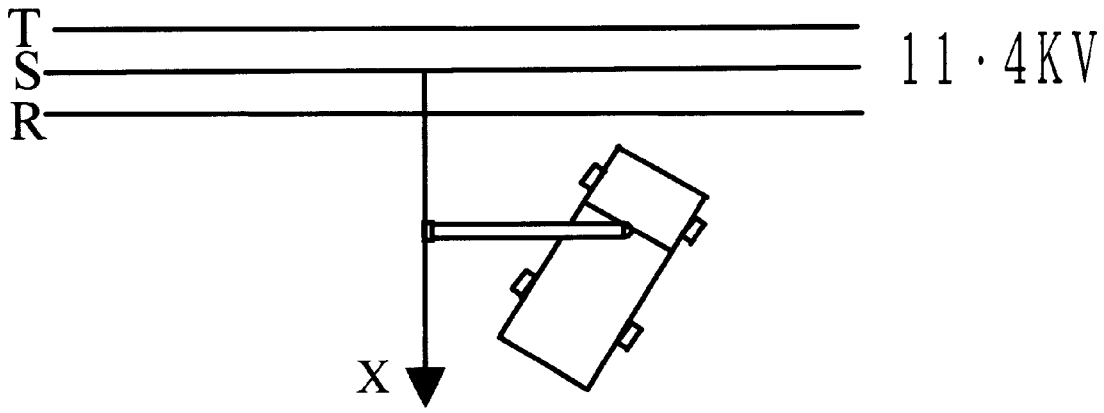
FIG. 15 shows a schematic view of the relative positions of the crane provided with the alarm device as shown in FIG.
Figure 16:
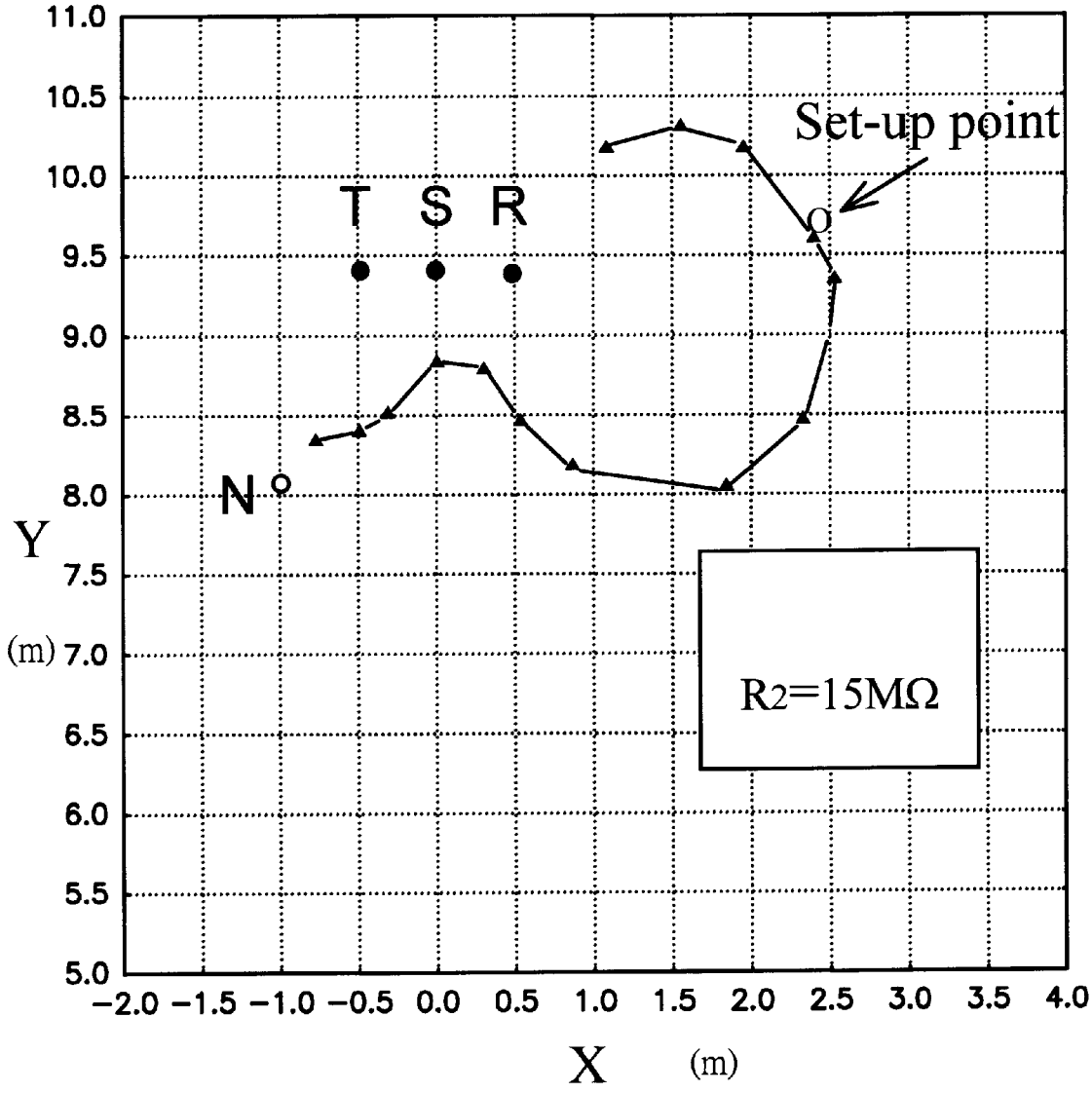

FIG. 16 shows an alarm range of the alarm device of FIG. 14, which is mounted on the inclined surface of the front end of the suspension arm of FIG. 15.

Figure 17:
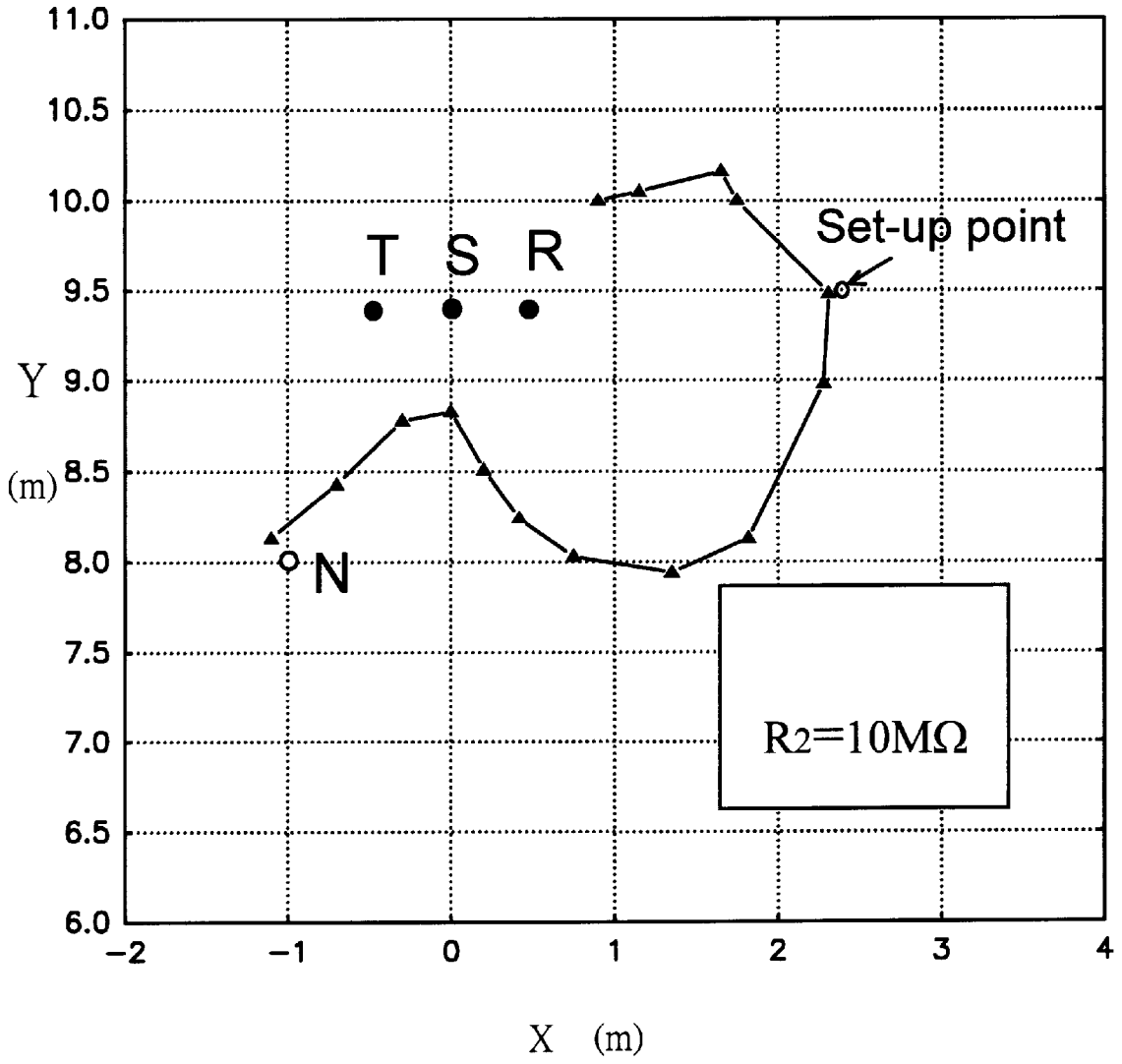

FIG. 17 shows an alarm range of the alarm device of FIG. 14, which is mounted on the vertical surface of the front end of the suspension arm of FIG. 15.

Figure 18:
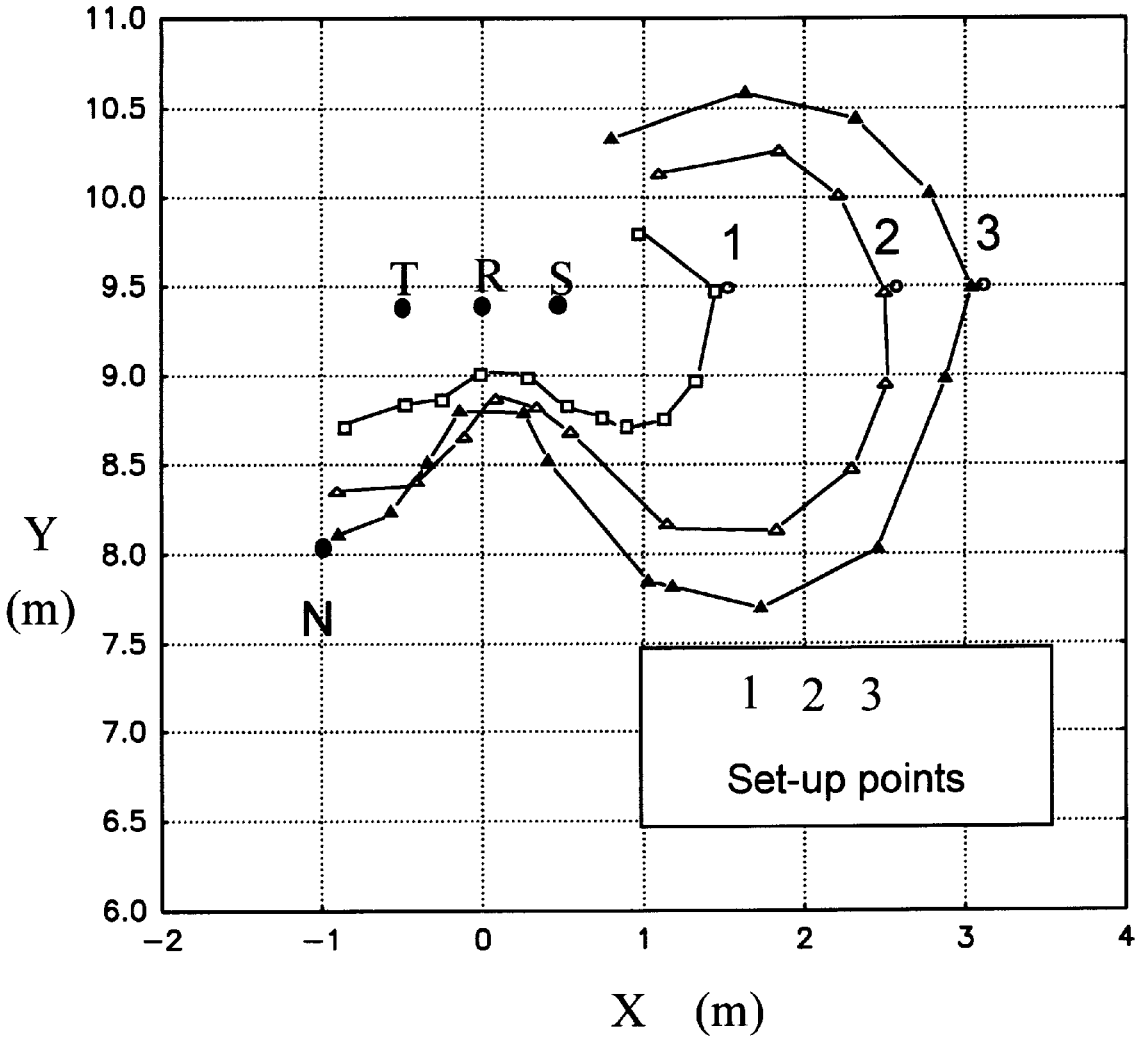

FIG. 18 shows alarm ranges of the alarm device mounted on various set-up points.

Figure 19:
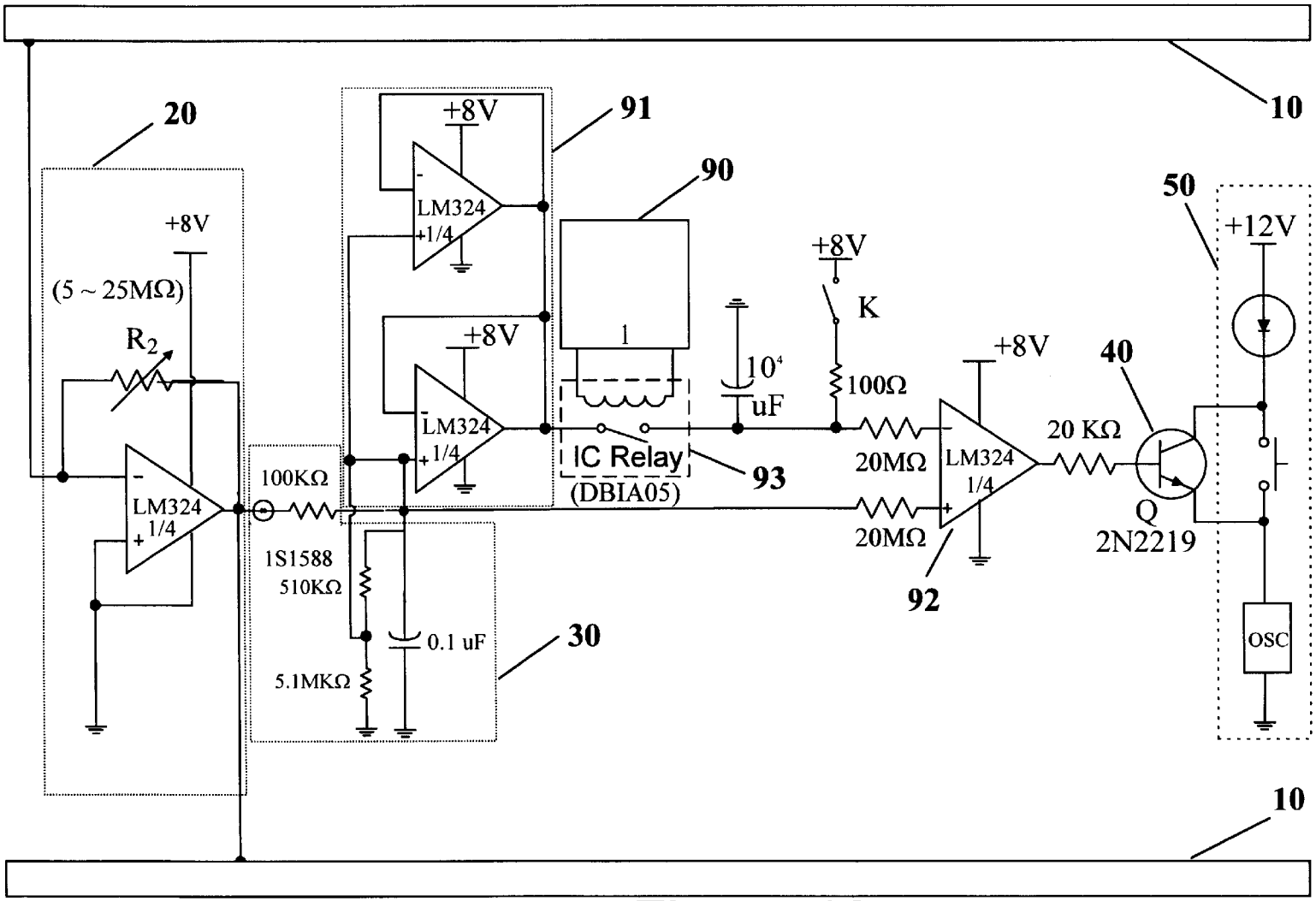

FIG. 19 shows a design layout of a circuitry of a peak-value analog type remote setting alarm device of the present invention.

Figure 20:
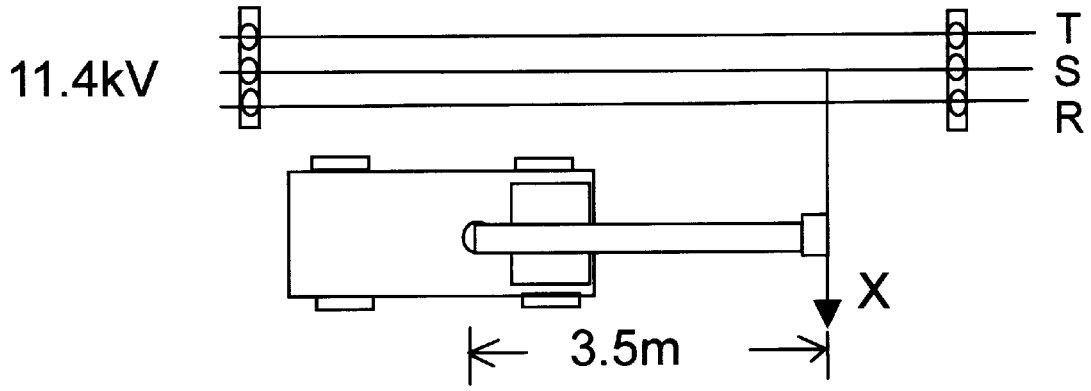

FIG. 20 shows a schematic view of relative positions of the overhead power distribution lines of the three-phase four-wire type and a crane provided with the alarm device of FIG. 19.

Figure 21:
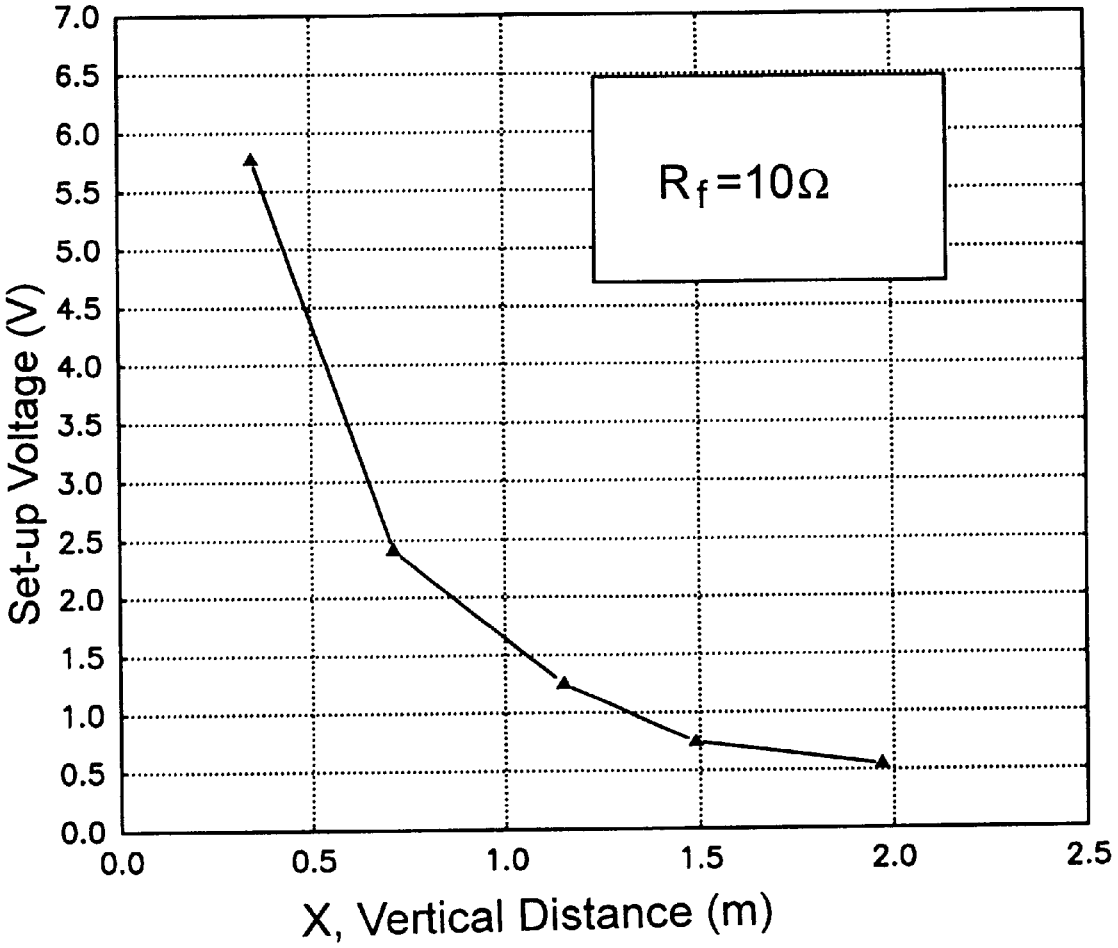

FIG. 21 shows a schematic view of the corresponding relationship between the set-up voltage and the vertical distance of the alarm device of FIG. 19 right under the S phase conductor of the 11.4 kV overhead power lines.

Figure 22:
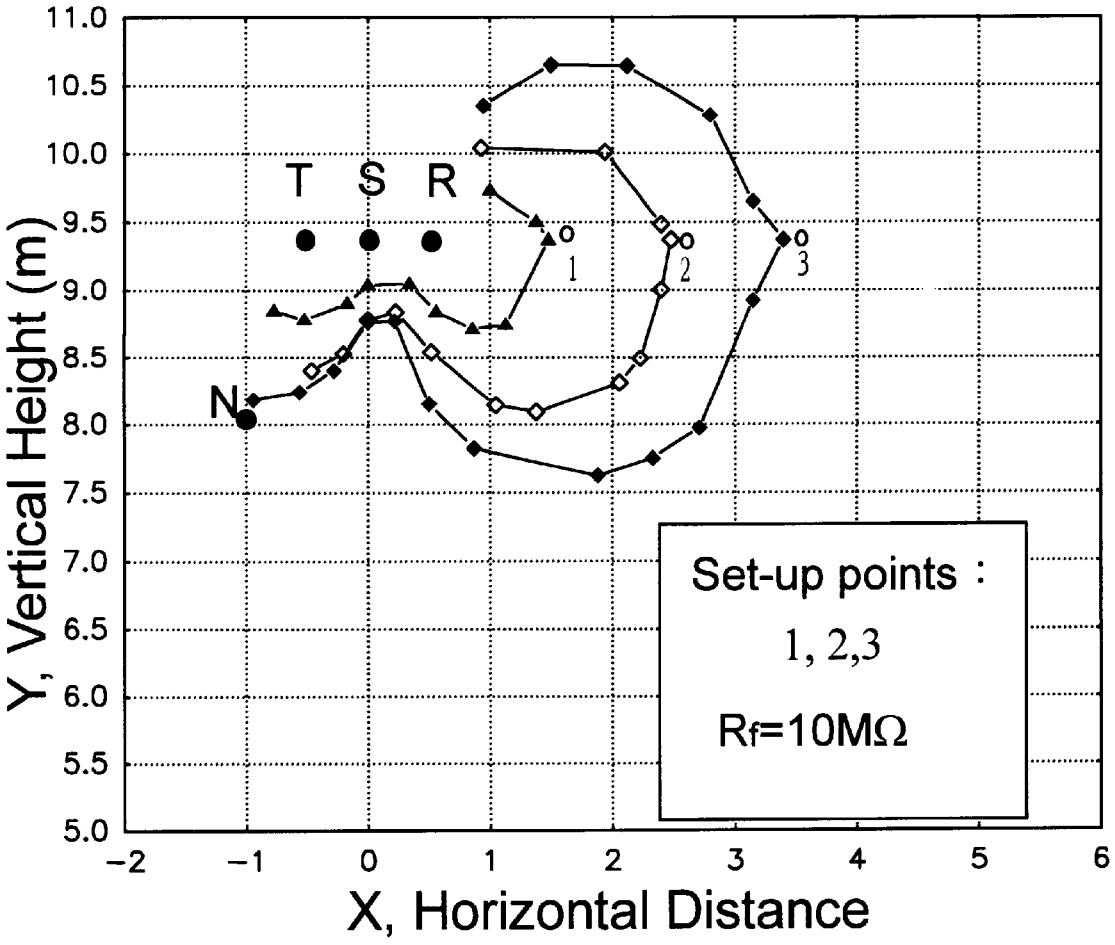

FIG. 22 shows alarm ranges of the alarm device mounted on three various set-up points.

Figure 23:
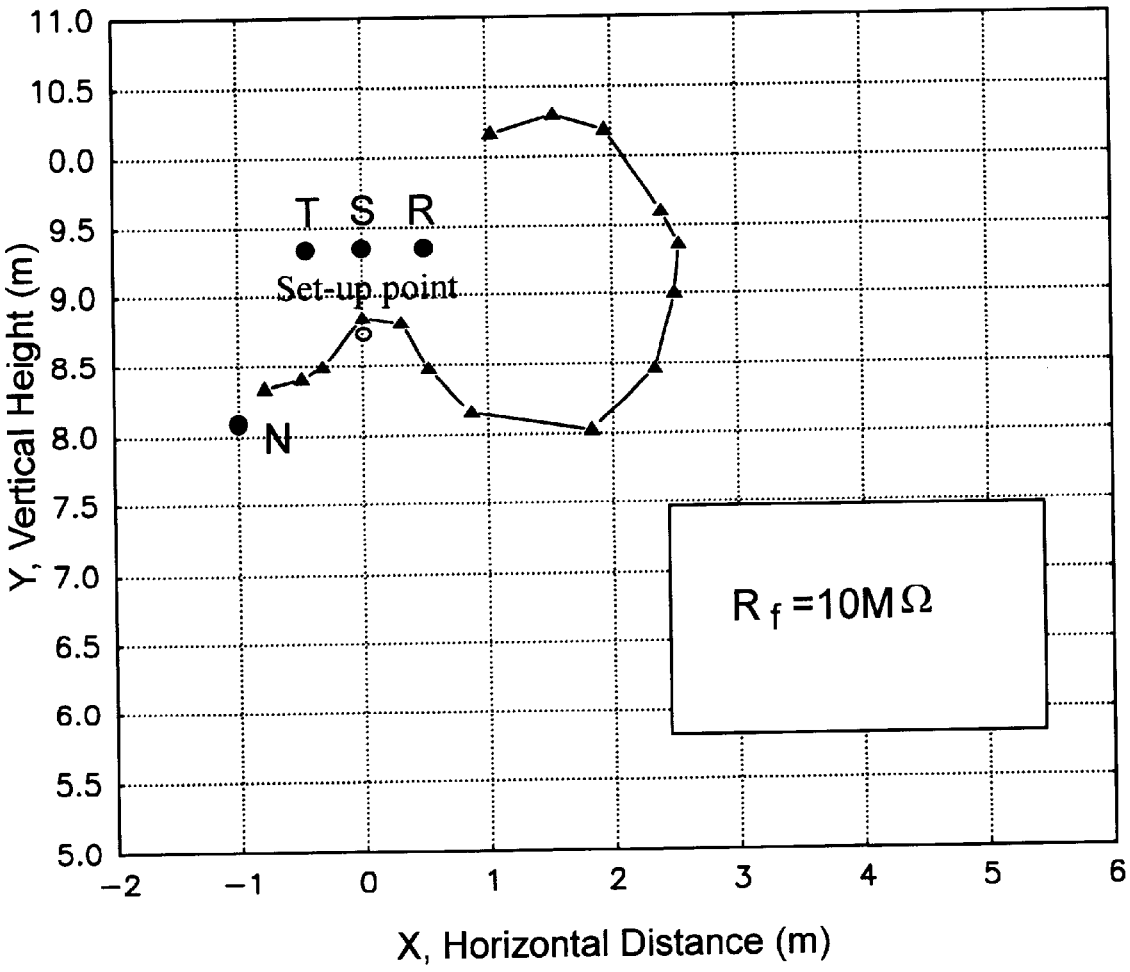

FIG. 23 shows an alarm range of the alarm device mounted at a set-up point right under the S phase conductor.

Figure 24:
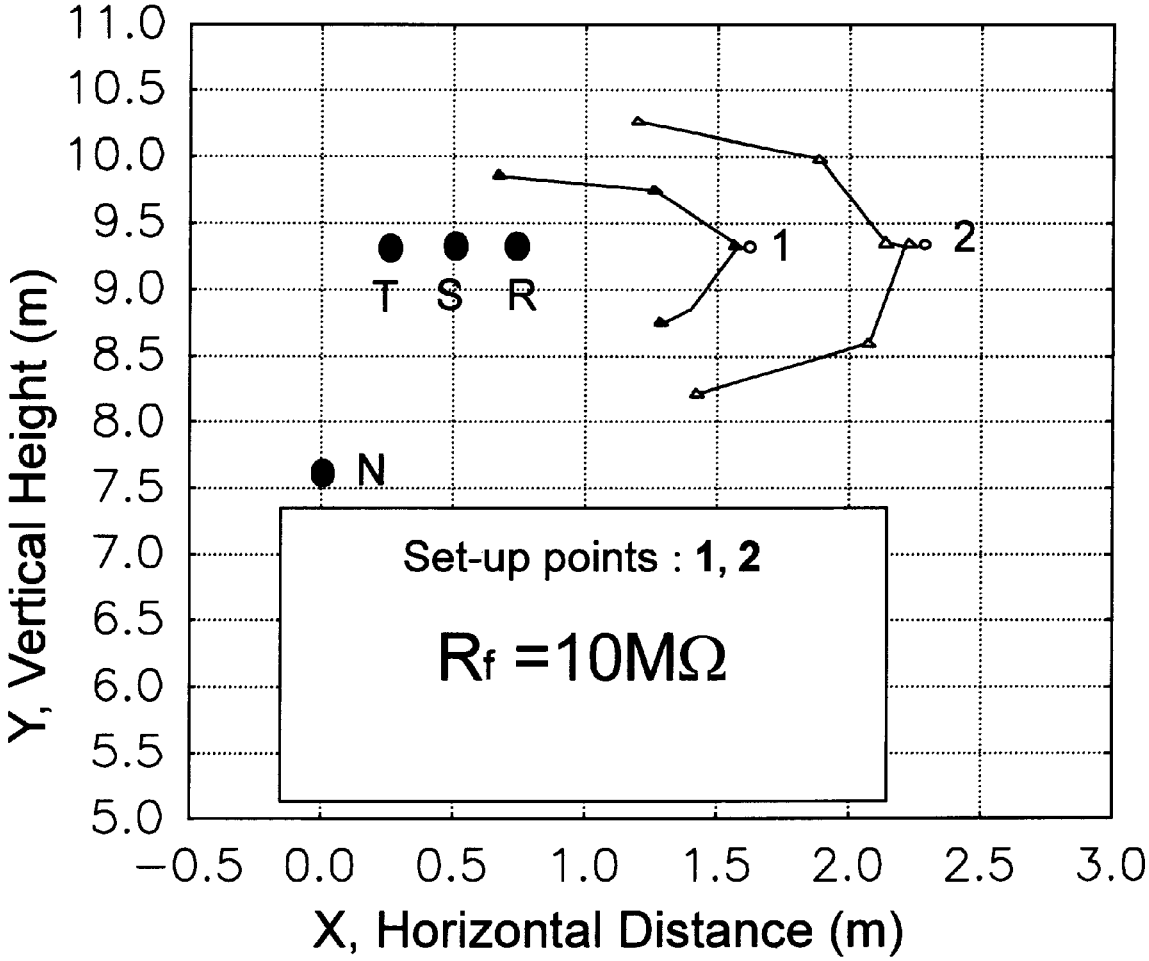

FIG. 24 shows alarm ranges of two different set-up points at the time when the alarm device is mounted at a middle position of the suspension arm.

Figure 25:
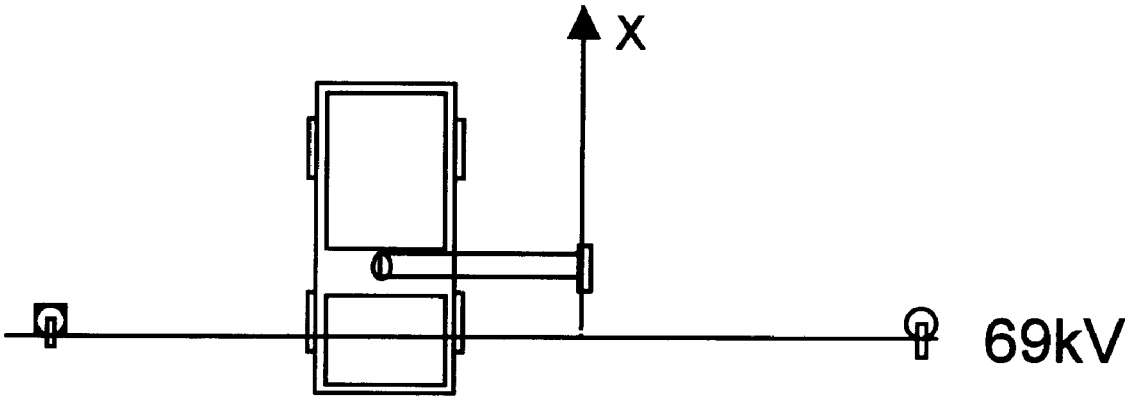

FIG. 25 shows a schematic view of relative positions of the crane provided with the alarm device of FIG. 19, and the 69 kV power transmission lines.

Figure 26:
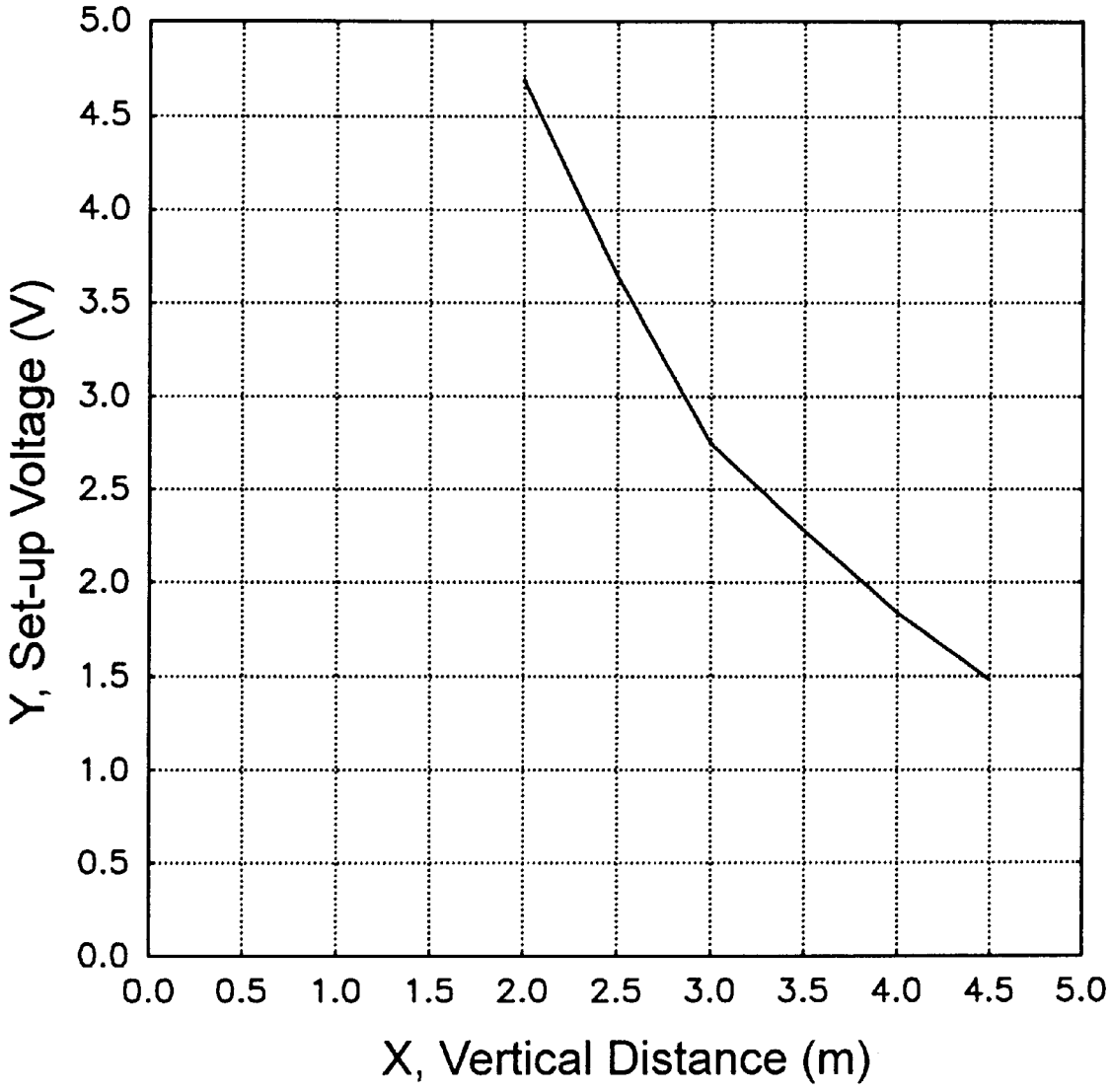

FIG. 26 shows a relationship between the set-up voltage and the vertical distance of the alarm device of FIG. 19, which is located under the 69 kV overhead power lines.

Figure 27:
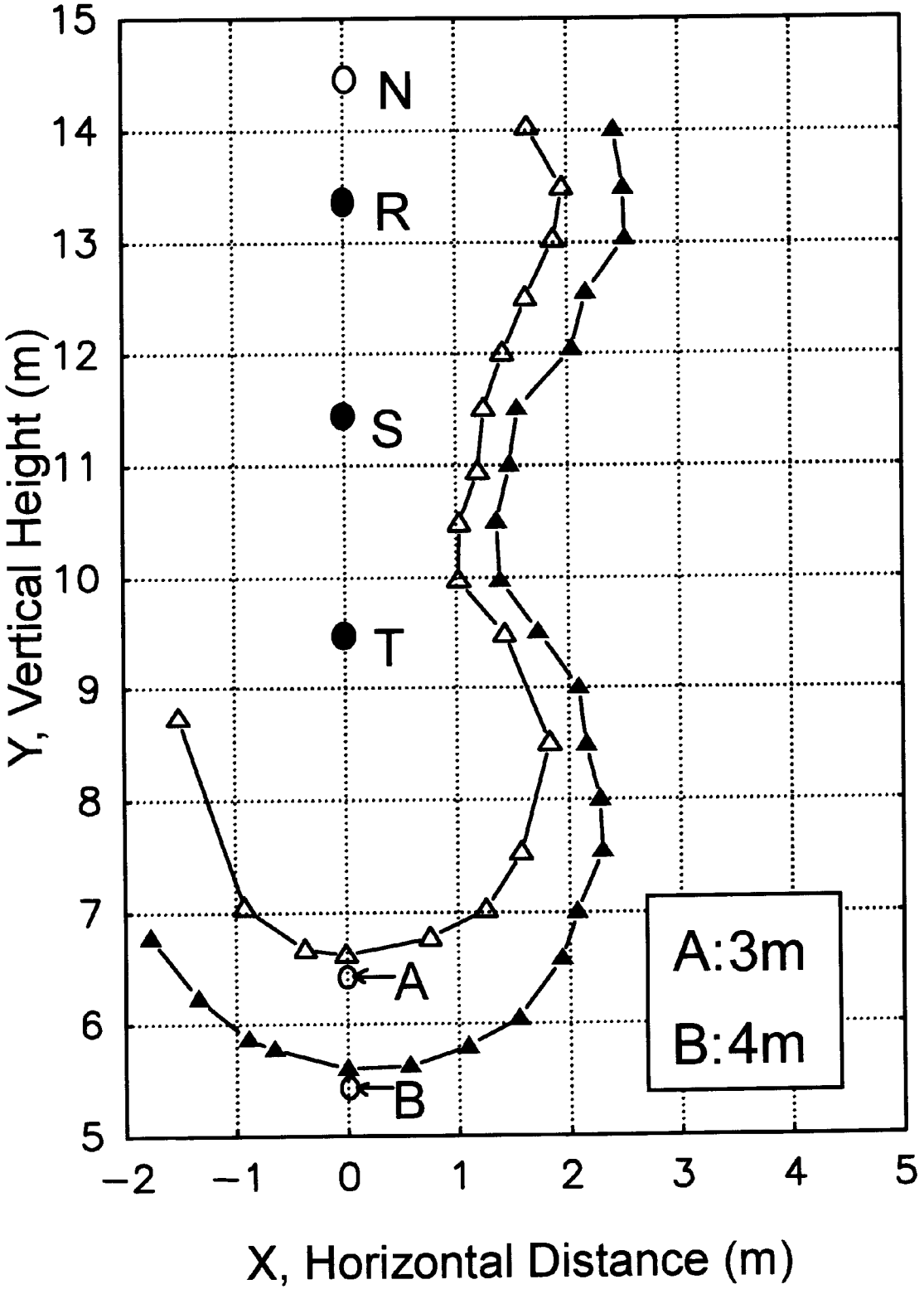

FIG. 27 shows alarm ranges when (A) the set-up point is located 3 m under the 69 kV power transmission lines, and when (B) the set-up point is located 4 m under the 69 kV power transmission lines.

Figure 28:
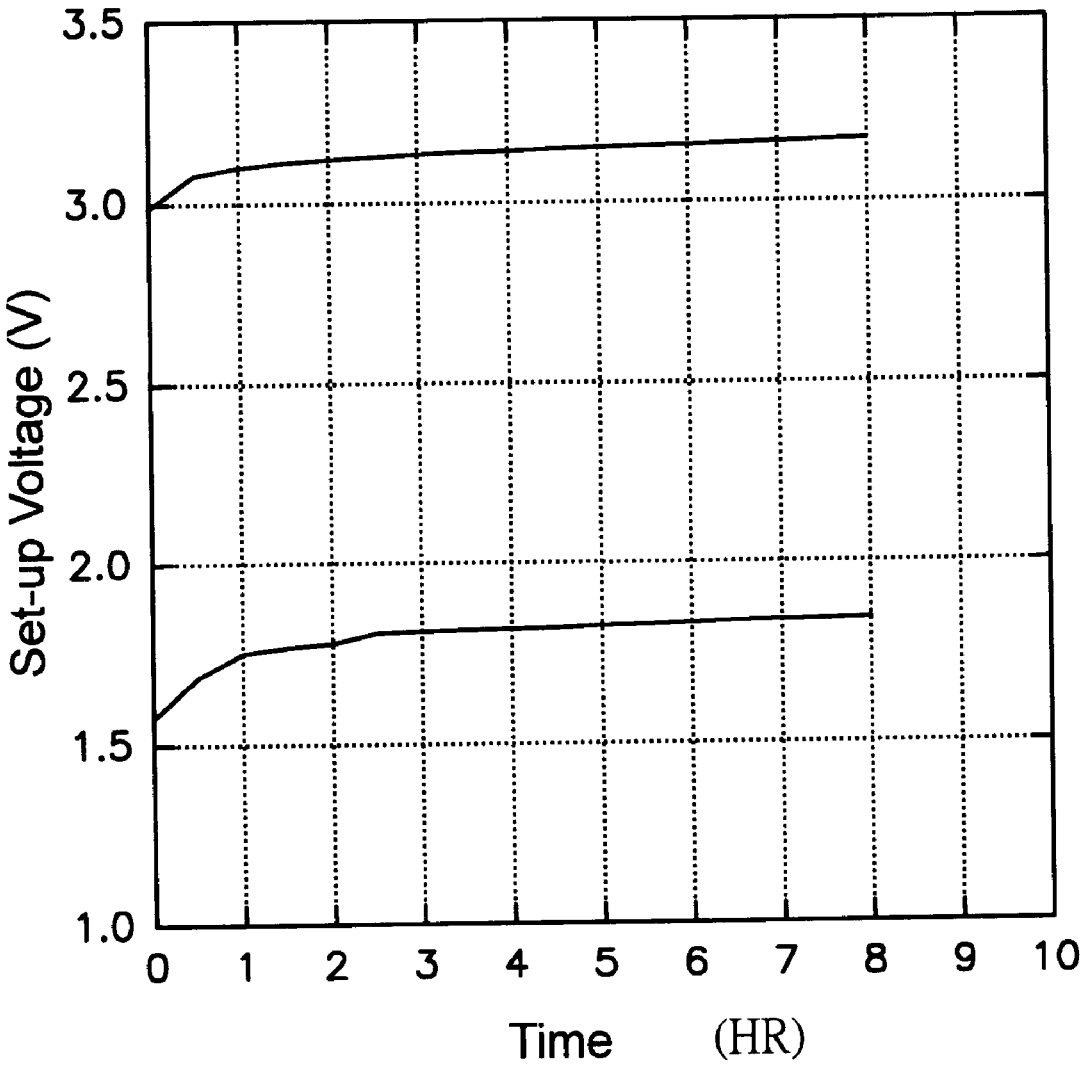

FIG. 28 shows a relationship between time and the voltage of the memory capacitor of the alarm device of FIG. 19.

Figure 29:
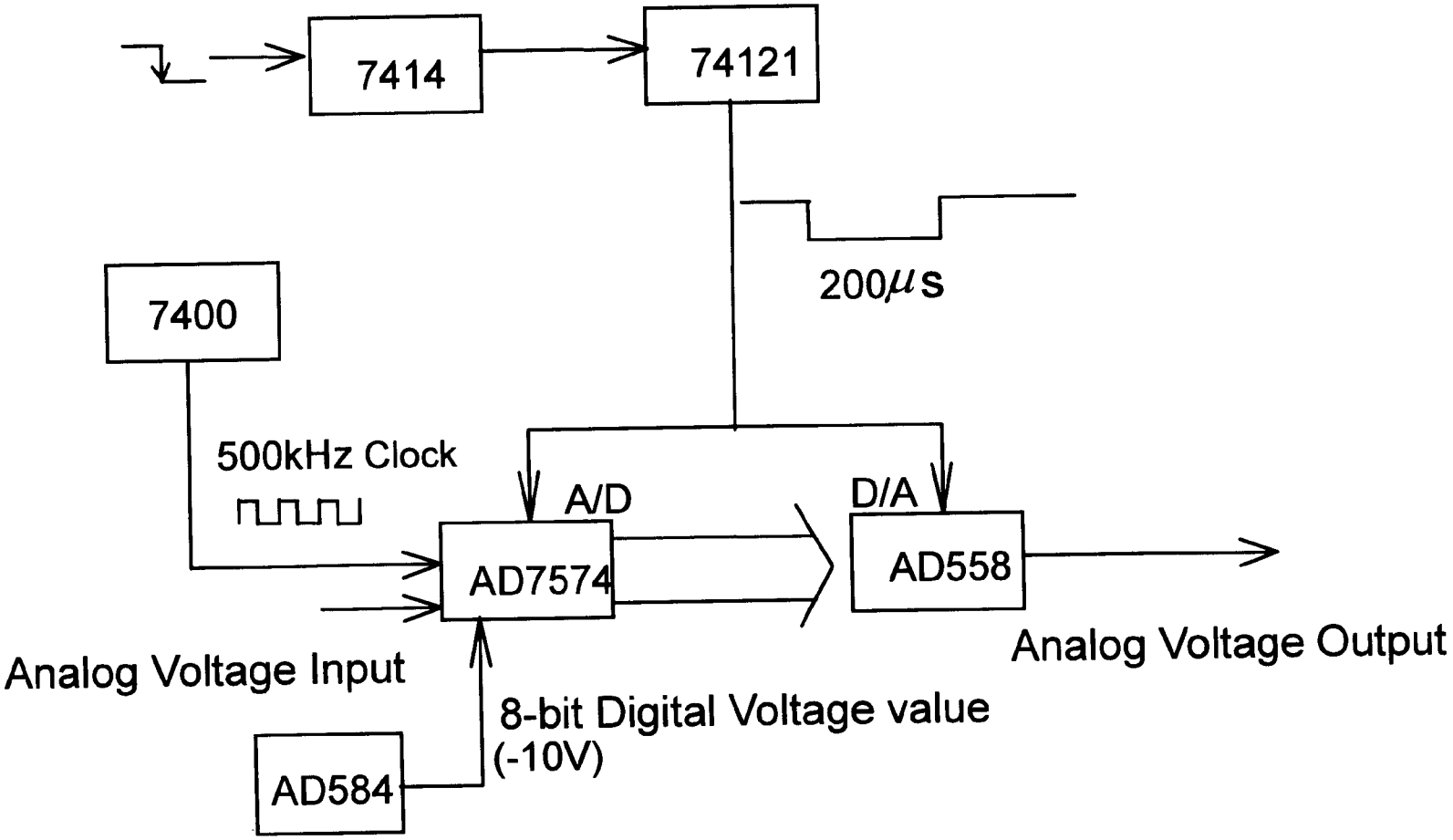

FIG. 29 shows a block diagram of the voltage memory unit of the digital alarm device of the present invention.

Figure 30:
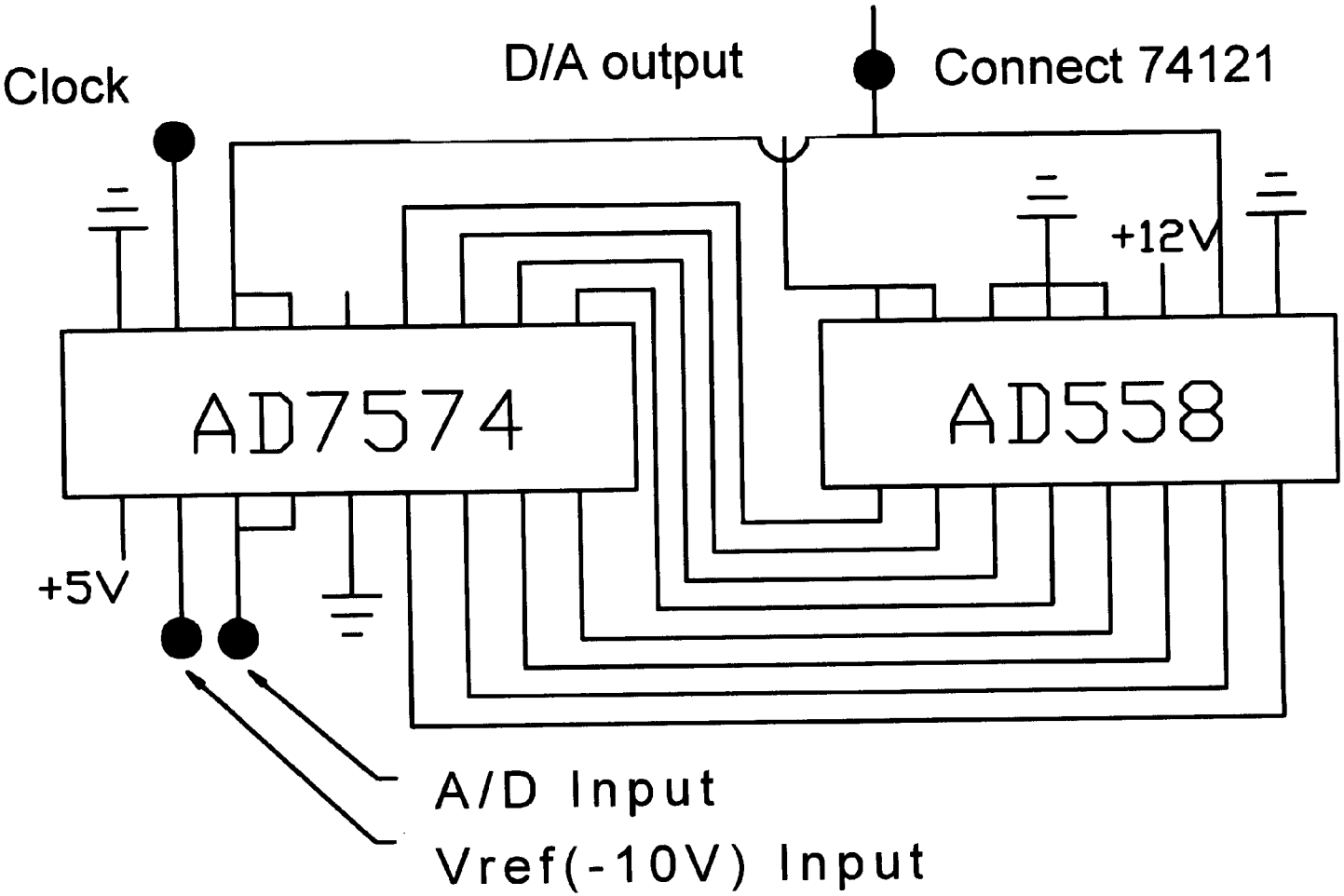

FIG. 30 shows a circuitry of the voltage memory unit of the digital alarm device of the present invention.

Figure 31:
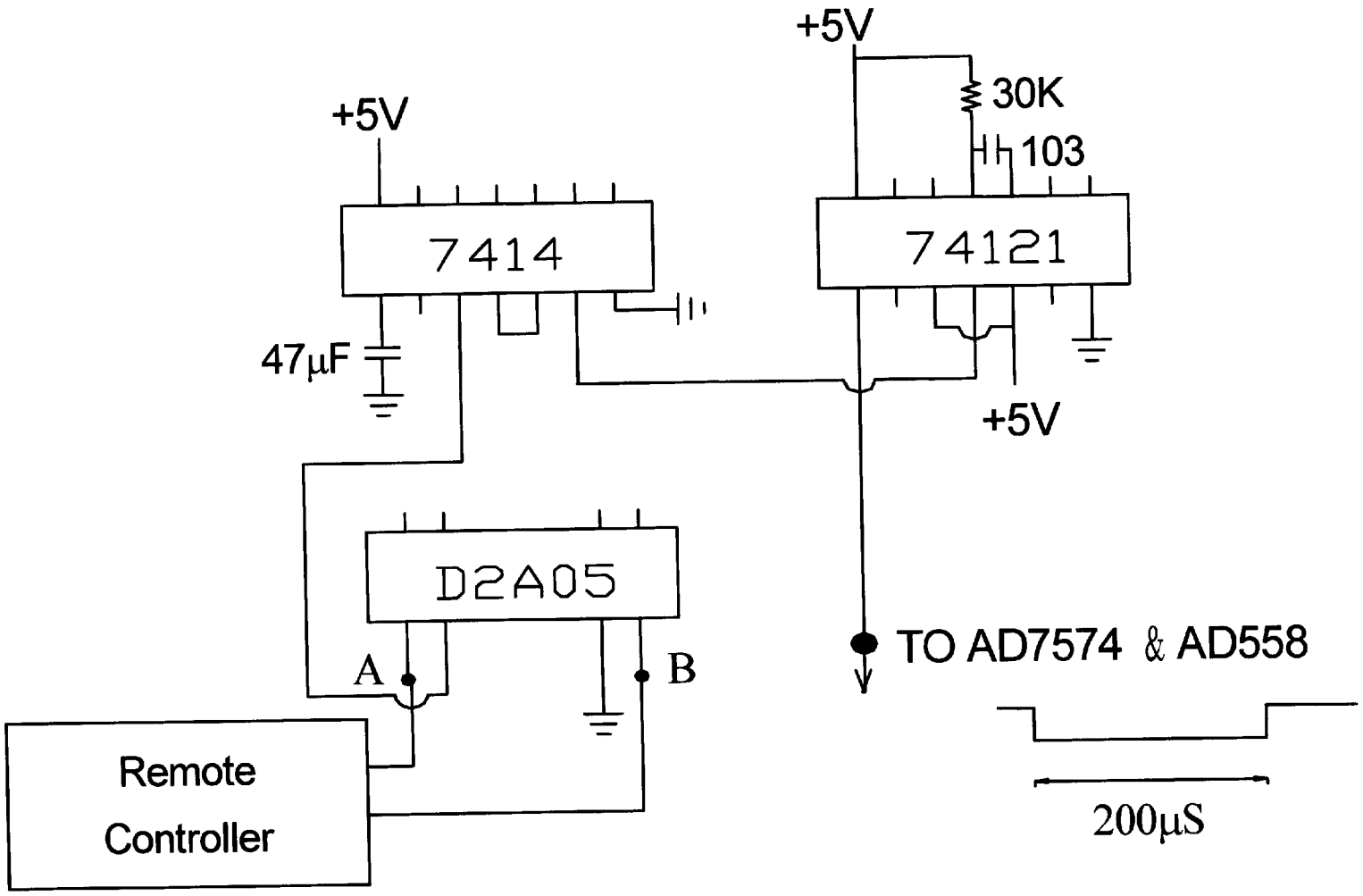

FIG. 31 shows a circuitry of a drive signal generator of the digital alarm device of the present invention.

Figure 32:
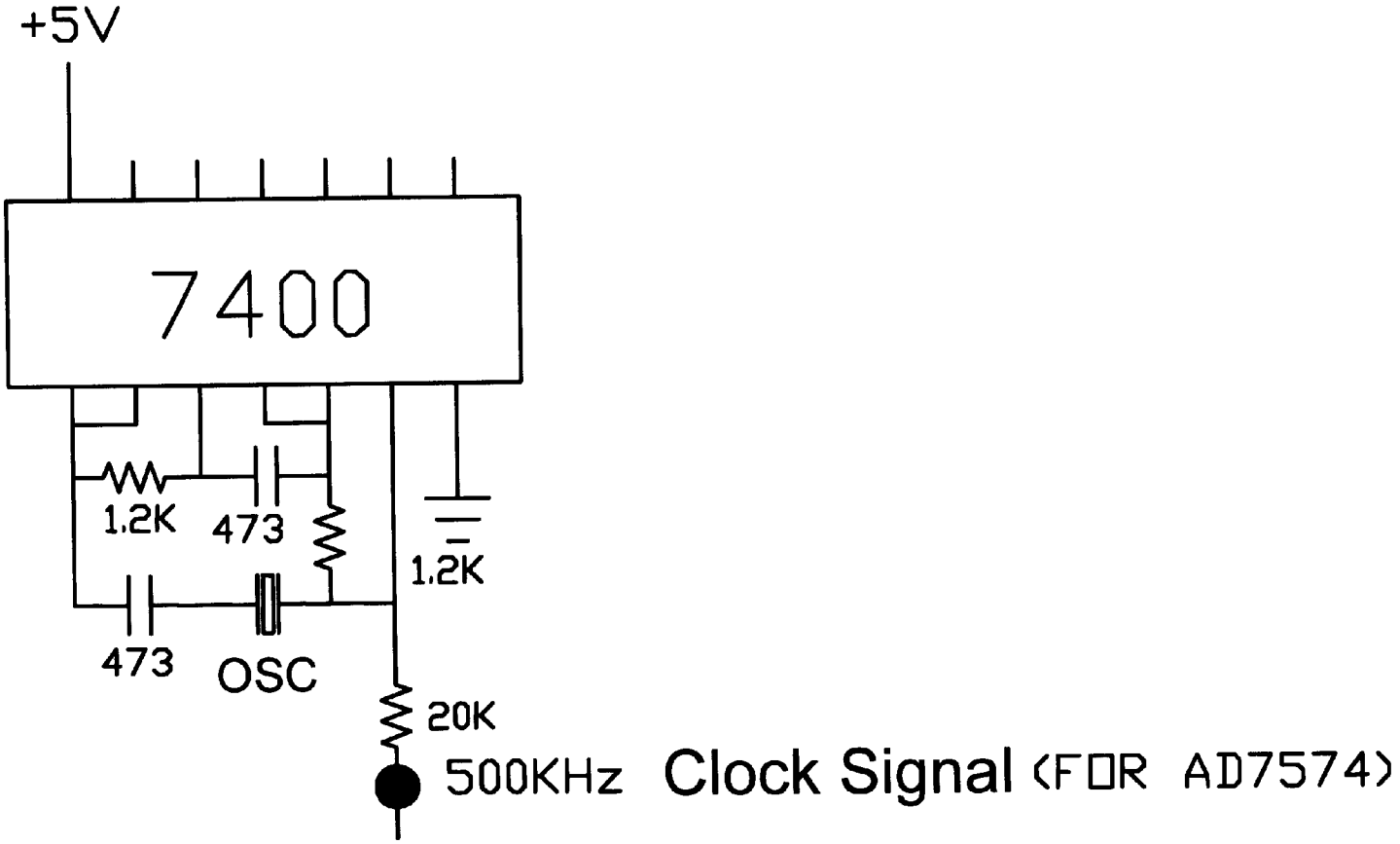

FIG. 32 shows a clock generator of the digital alarm device of the present invention.

Figure 33:
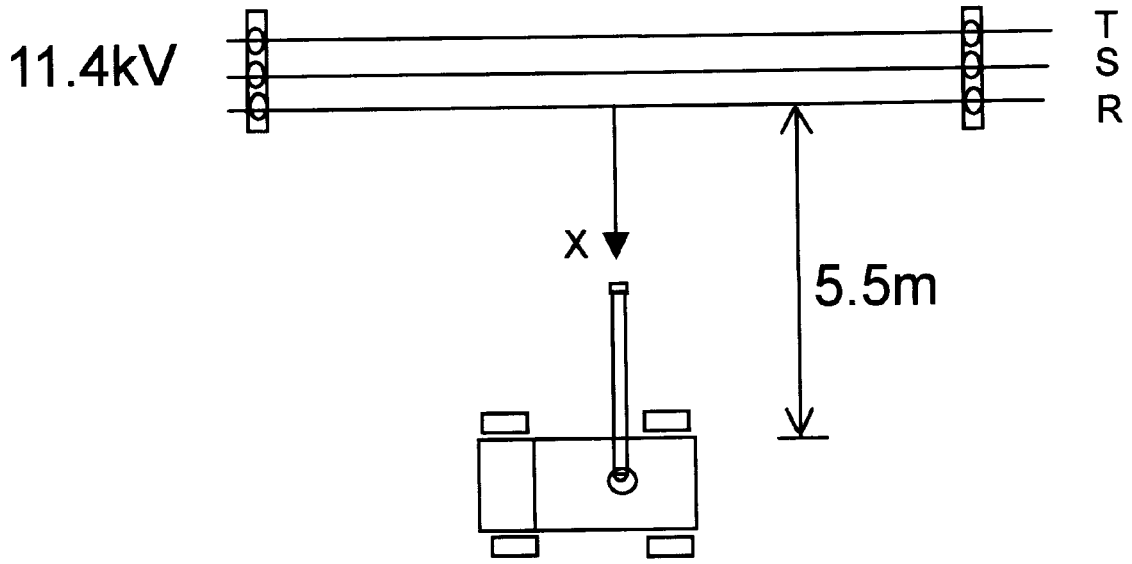

FIG. 33 shows a schematic view of relative positions of a crane provided with the digital alarm device of the present invention and the overhead power distribution lines of the three-phase four-wire (3ϕ4 w) connection.

Figure 34:
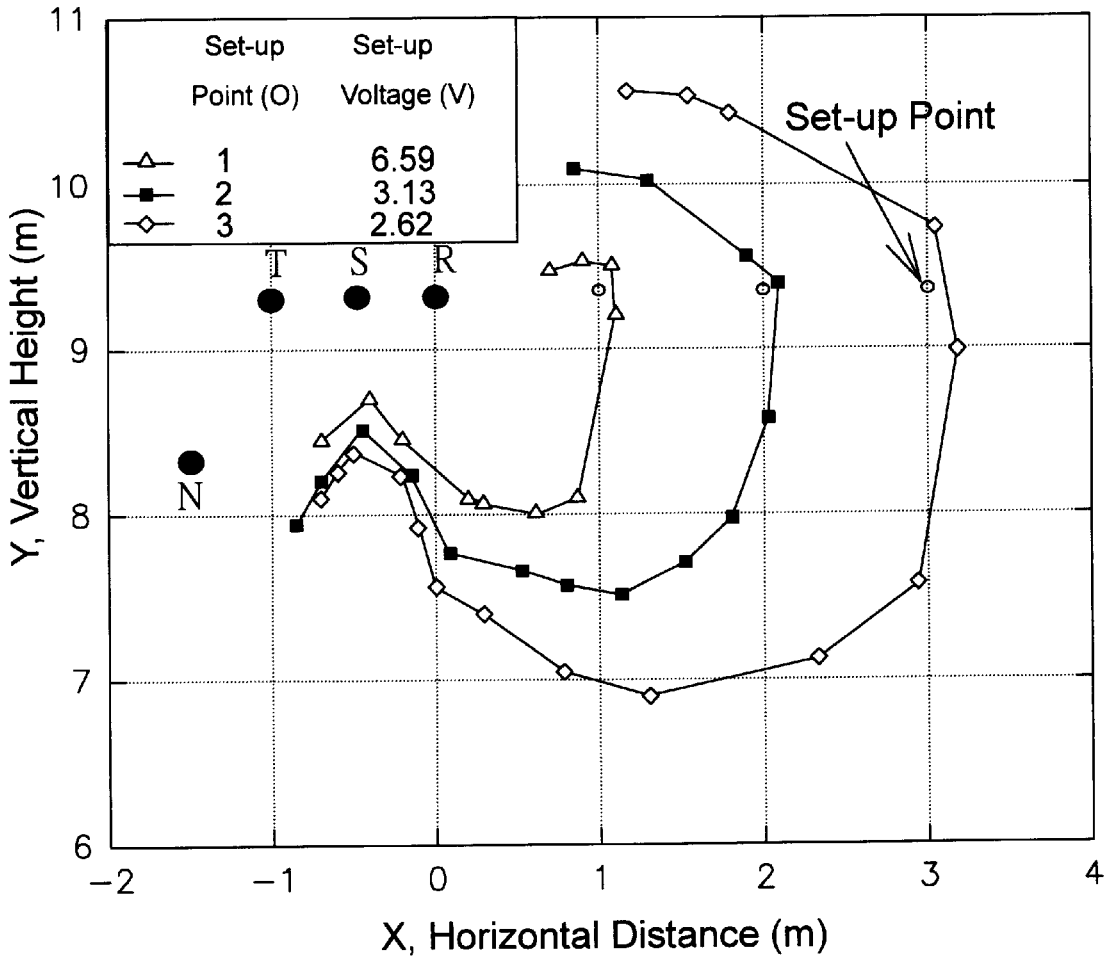

FIG. 34 shows the alarm ranges of the digital alarm device of the present invention located at the set-up points having a vertical height of 9.3 meters and horizontal distances of 1 meter (set-up voltage of 6.59V), 2 meters (set-up voltage of 3.13V) and 3 meters (set-up voltage of 2.62V).

Figure 35:
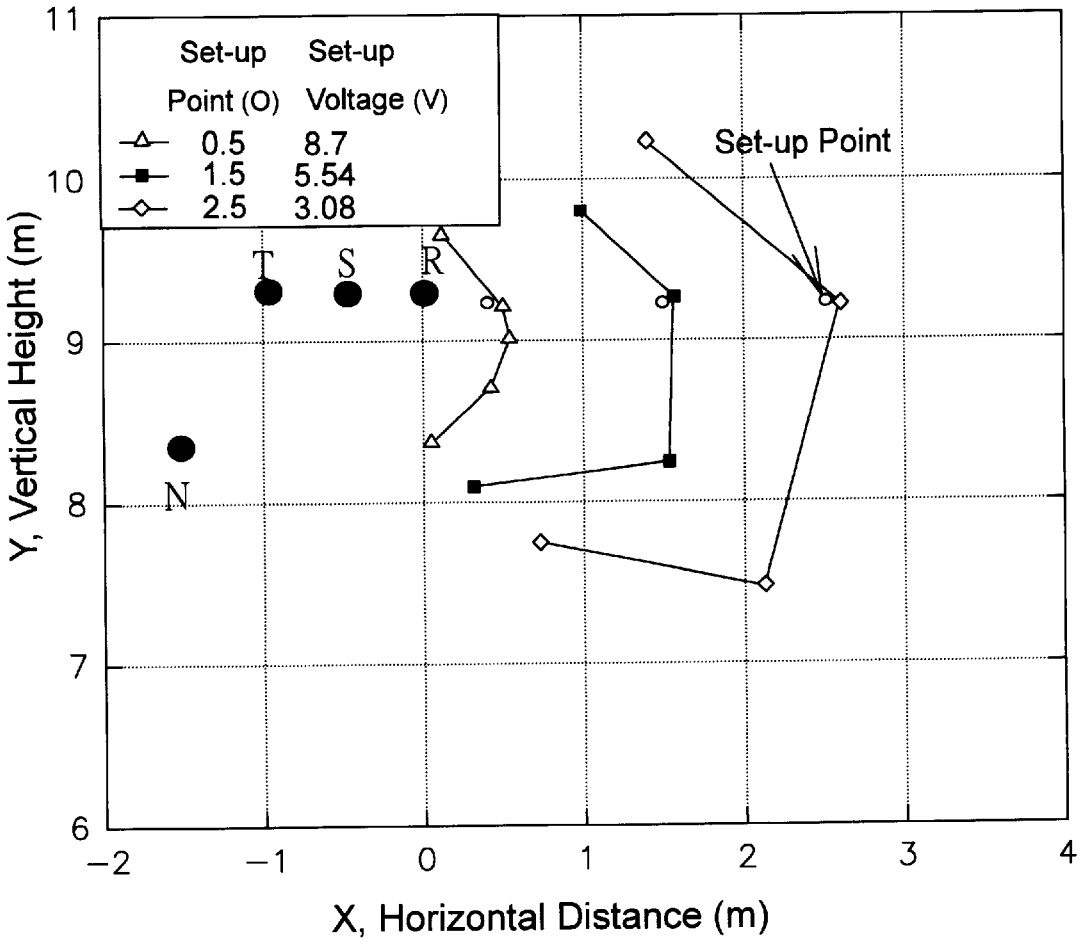

FIG. 35 shows the alarm ranges of the digital alarm device of the present invention located at the set-up points having a vertical height of 9.3 meters and horizontal distances of 0.5 meter (set-up voltage of 8.7V), 1.5 meters (set-up voltage of 5.54V) and 2.5 meters (set-up voltage of 3.08V).

Figure 36:
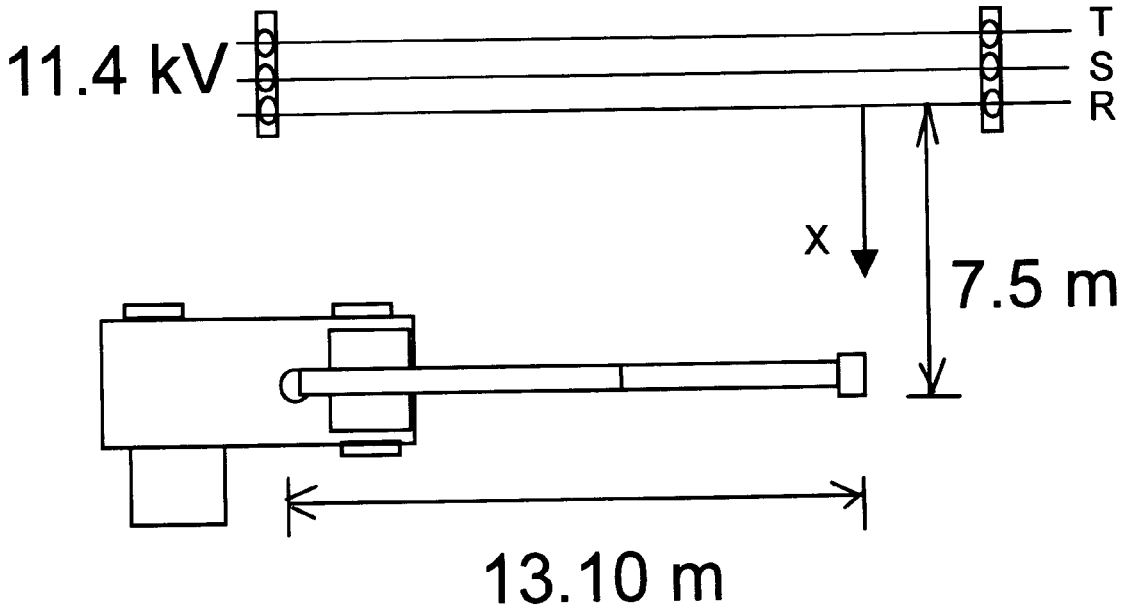

FIG. 36 shows a schematic view of relative positions of a crane provided with the digital alarm device of the present invention, and the overhead power distribution lines of the three-phase four-wire (3ϕ4 w) connection.

Figure 37:
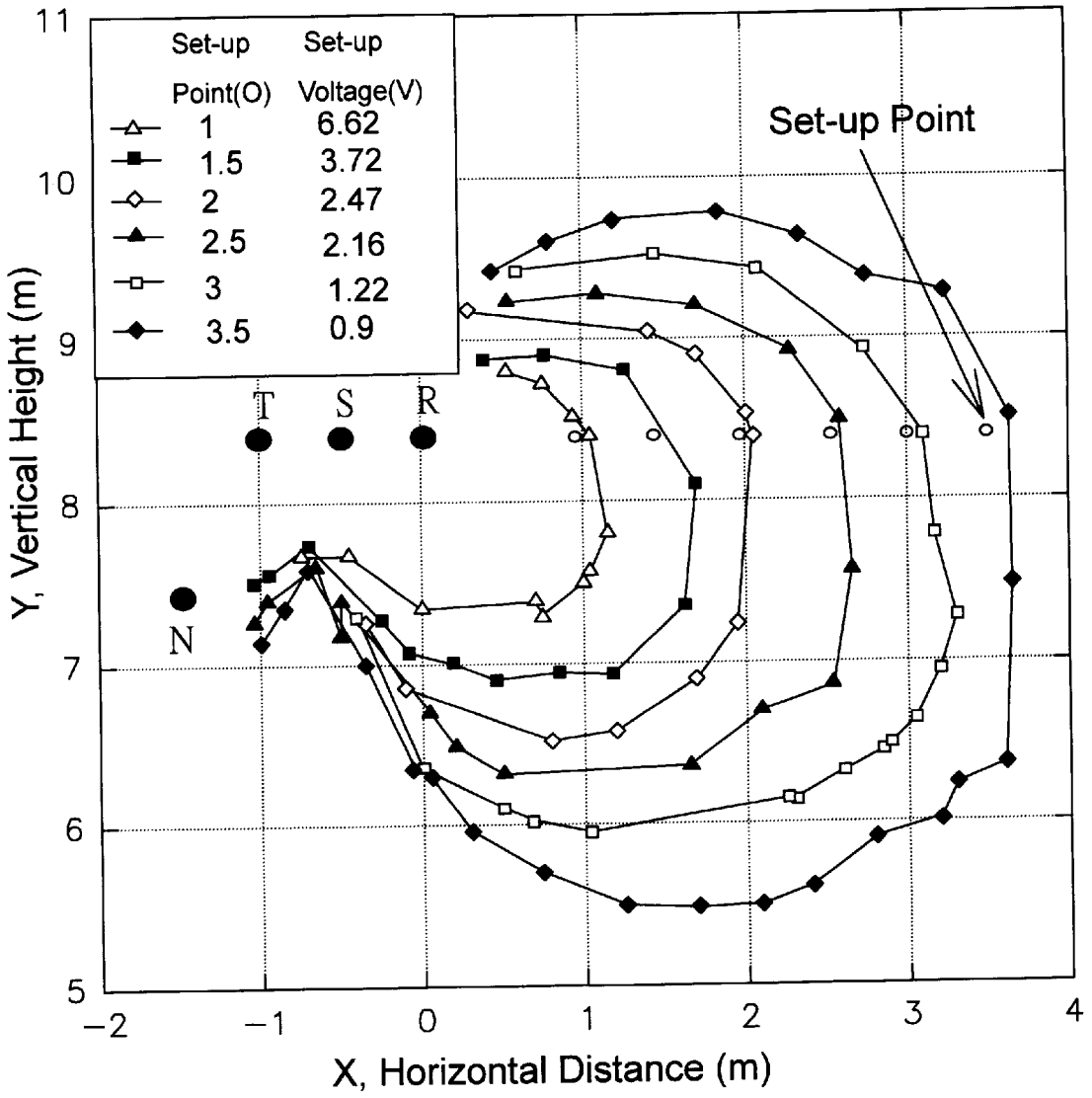

FIG. 37 shows alarm ranges of the digital alarm device of the present invention (negative feedback resistance of 15 MΩ) at the set-up points of the vertical height of 8.4 meters and various horizontal distances.

Figure 38:
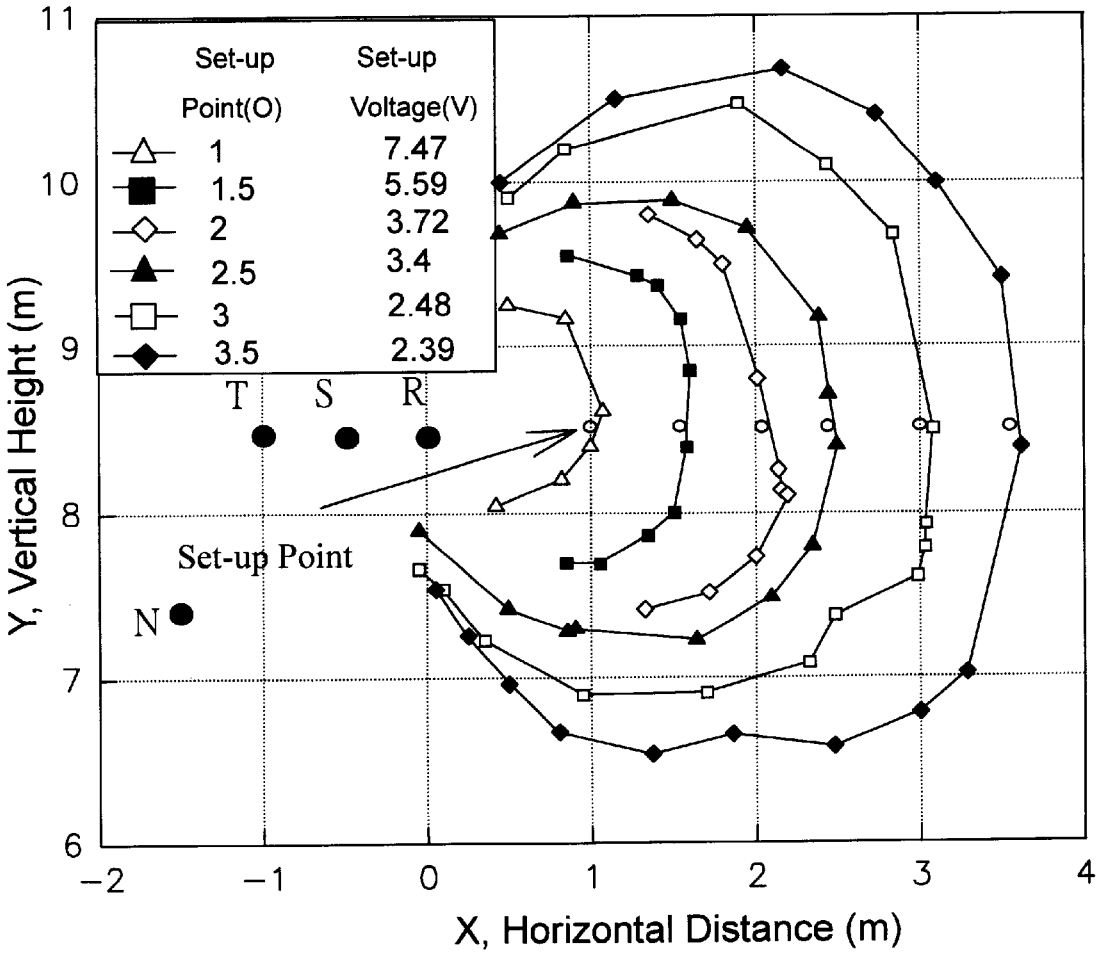

FIG. 38 shows alarm ranges of the digital alarm device of the present invention (negative feedback resistance of 22 M Ω) at the set-up points of the vertical height of 8.4 meters and various horizontal distances.

Figure 39:
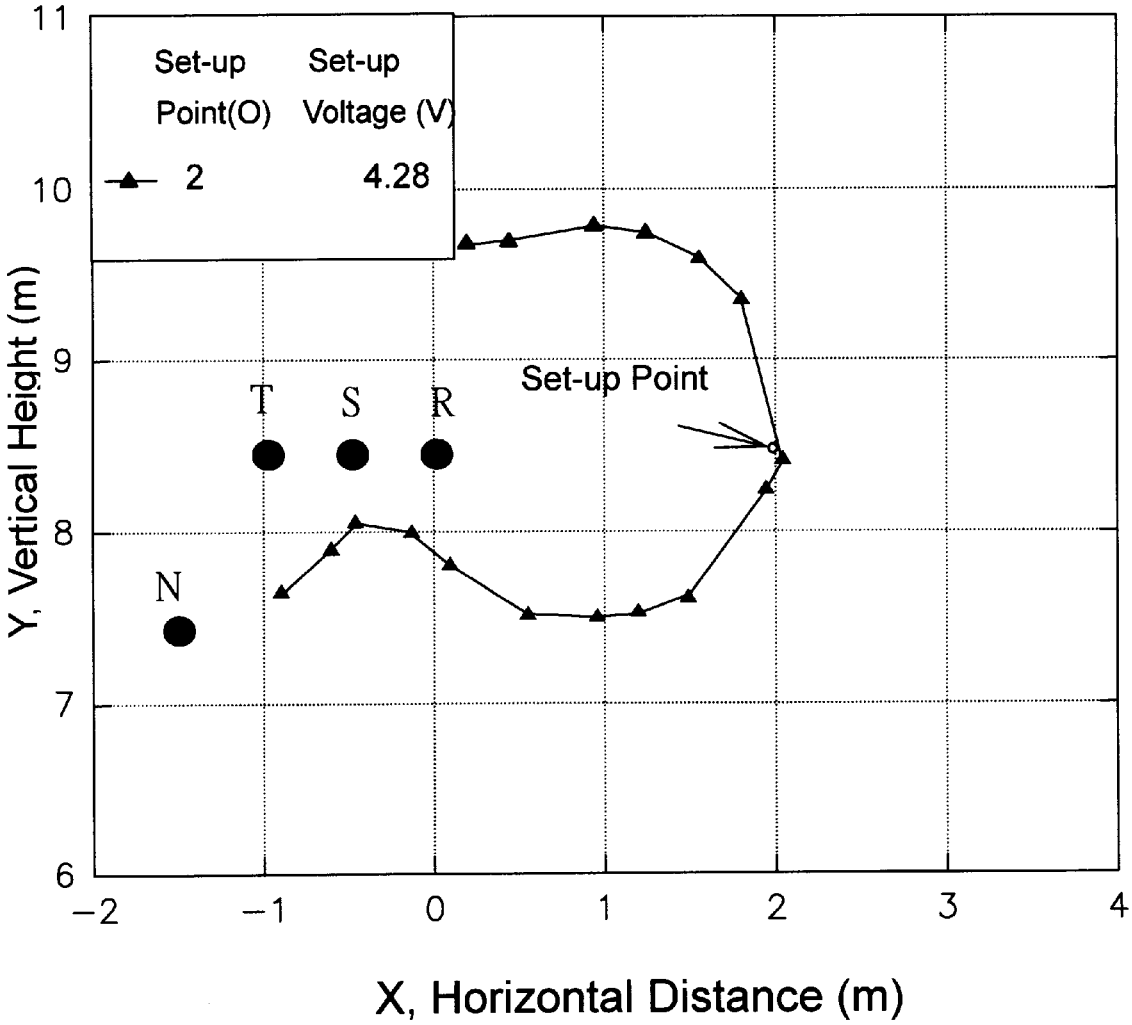

FIG. 39 shows an alarm range of the digital alarm device of the present invention (negative feedback resistance of 15 MΩ) at a set-up point of the vertical height of 8.4 meters and the horizontal distance of 2 meters (set-up voltage of 4.28V) from single loop 11.4 kV power distribution lines, which is located at the side surface of the top end of the suspension arm.

Figure 40:
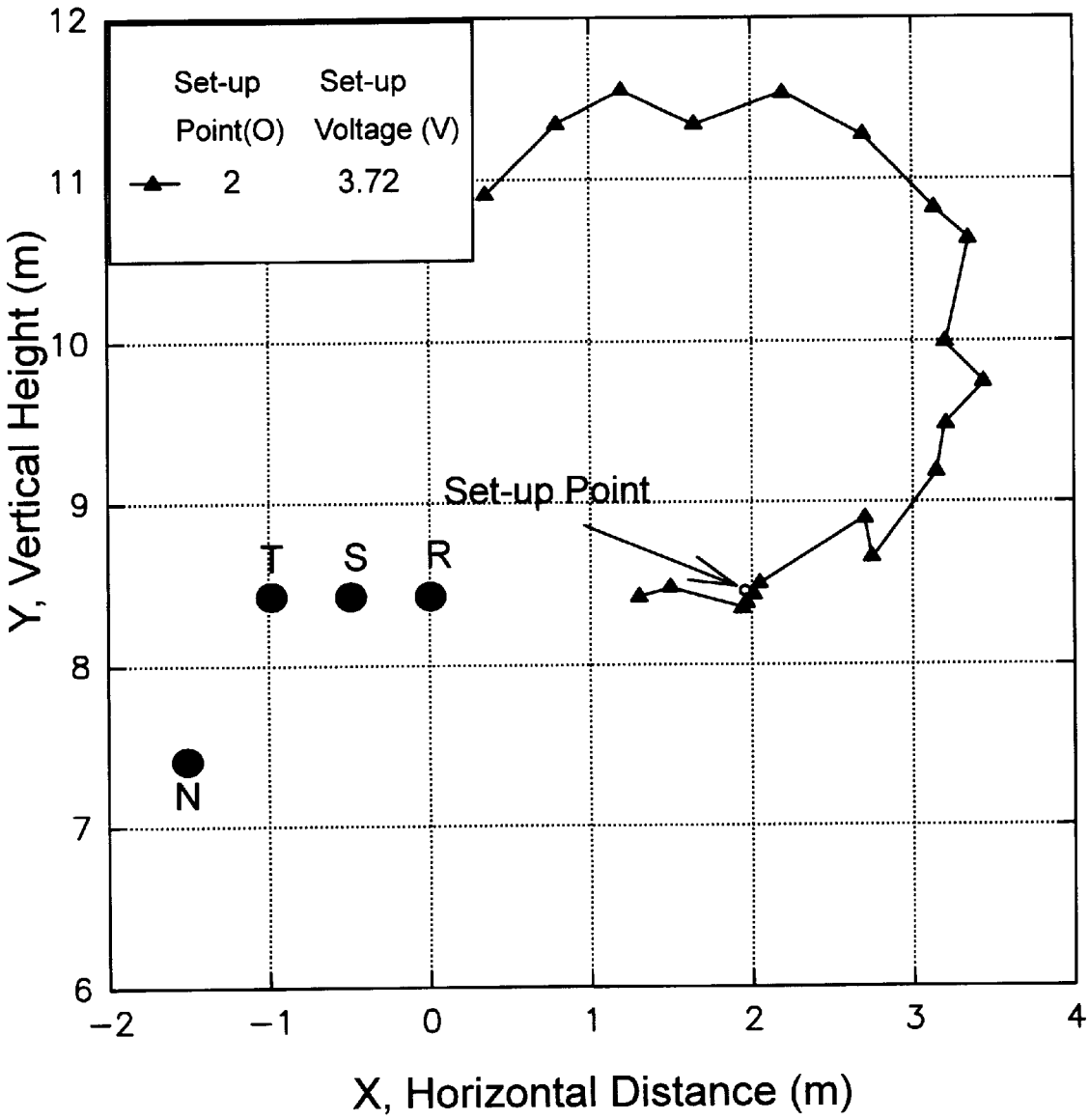

FIG. 40 shows an alarm range of the digital alarm device of the present invention under situations similar to FIG. 39 except that the digital alarm device is located at the side surface of the second segment at the middle of a suspension arm.

Figure 41:
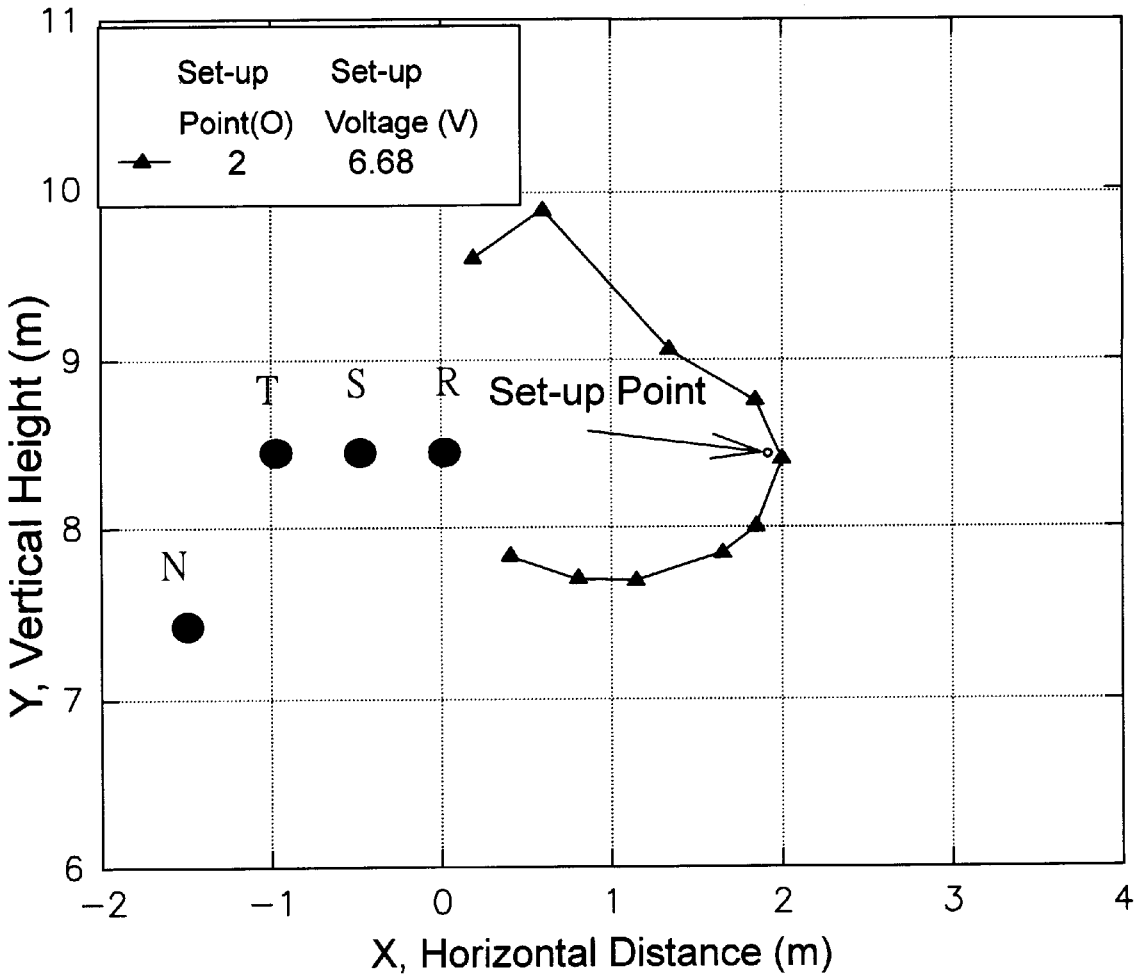

FIG. 41 shows an alarm range of the digital alarm device of the present invention under situations similar to FIG. 39 except that the digital alarm device is located at a hook of a suspension arm.

Figure 42:
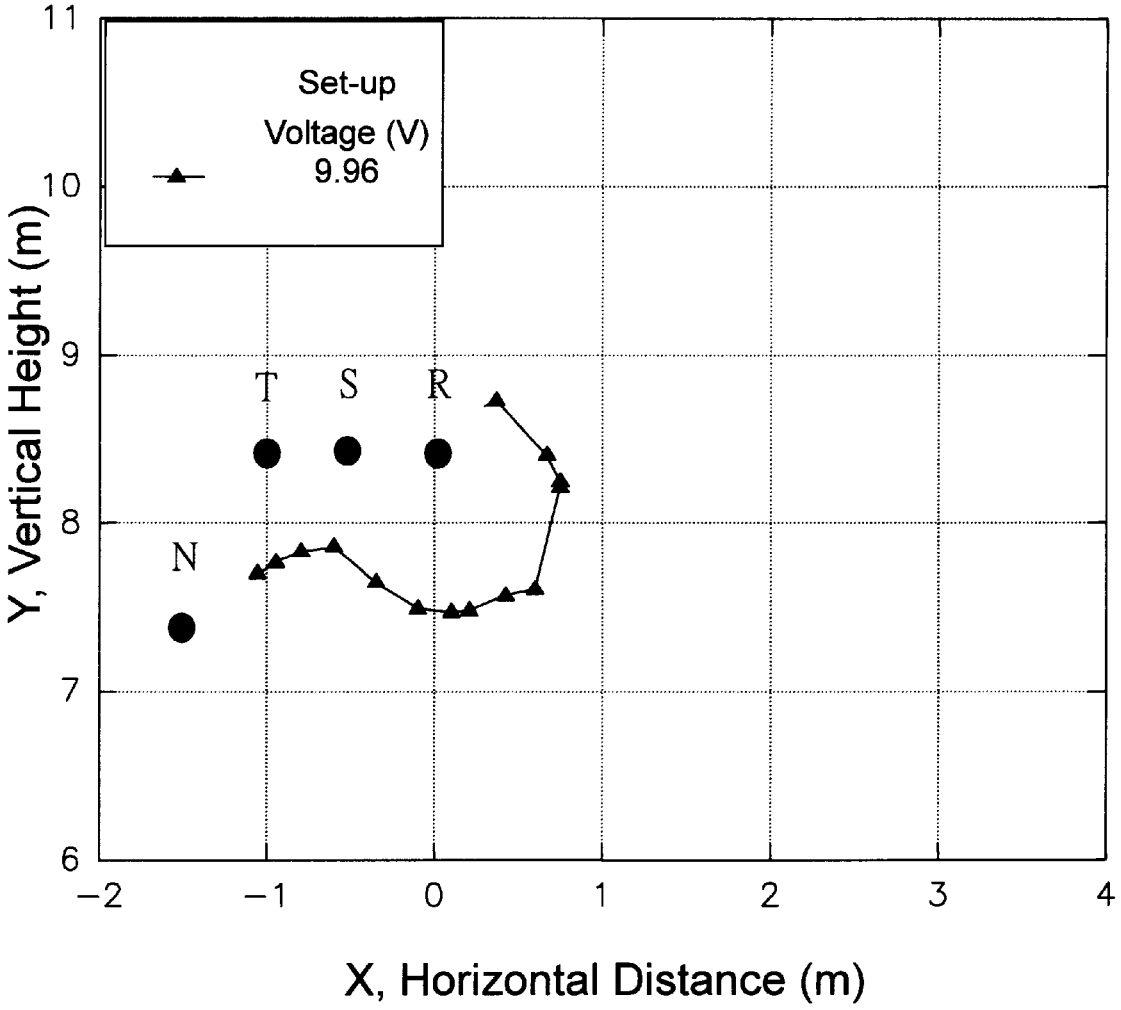

FIG. 42 shows an alarm range of the digital alarm device of the present invention under situations similar to FIG. 39 except that the digital alarm device is located at the front surface of the top end of the suspension arm and the reference level voltage is not set (that is the maximum value of 9.96V).

Figure 43:
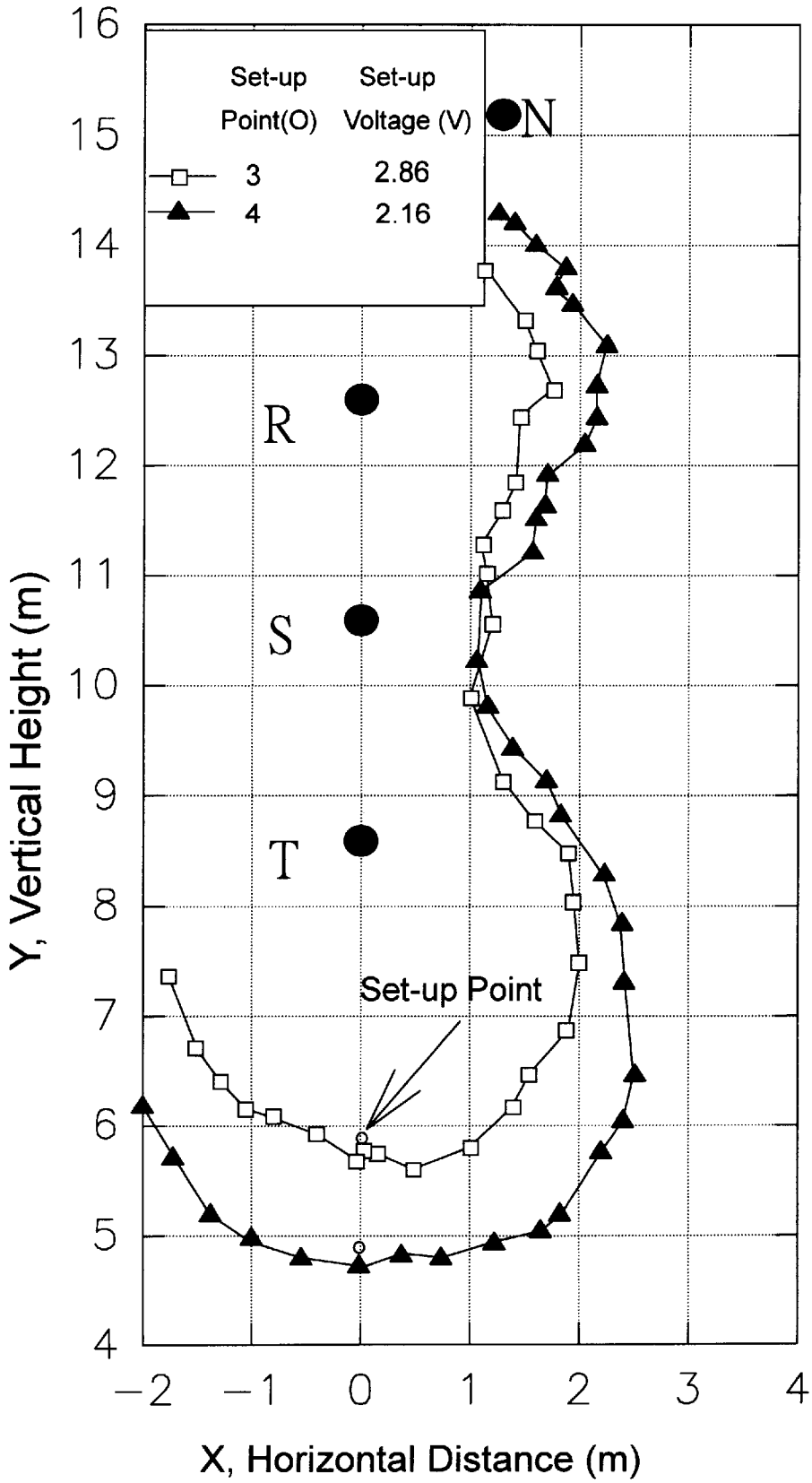

FIG. 43 shows alarm ranges of the digital alarm device of the present invention (negative feedback resistance of 1 MΩ) with various set-up points, which is located at the front surface of the top end of the suspension arm and contiguous to 69 kV overhead power lines.

Figure 44:
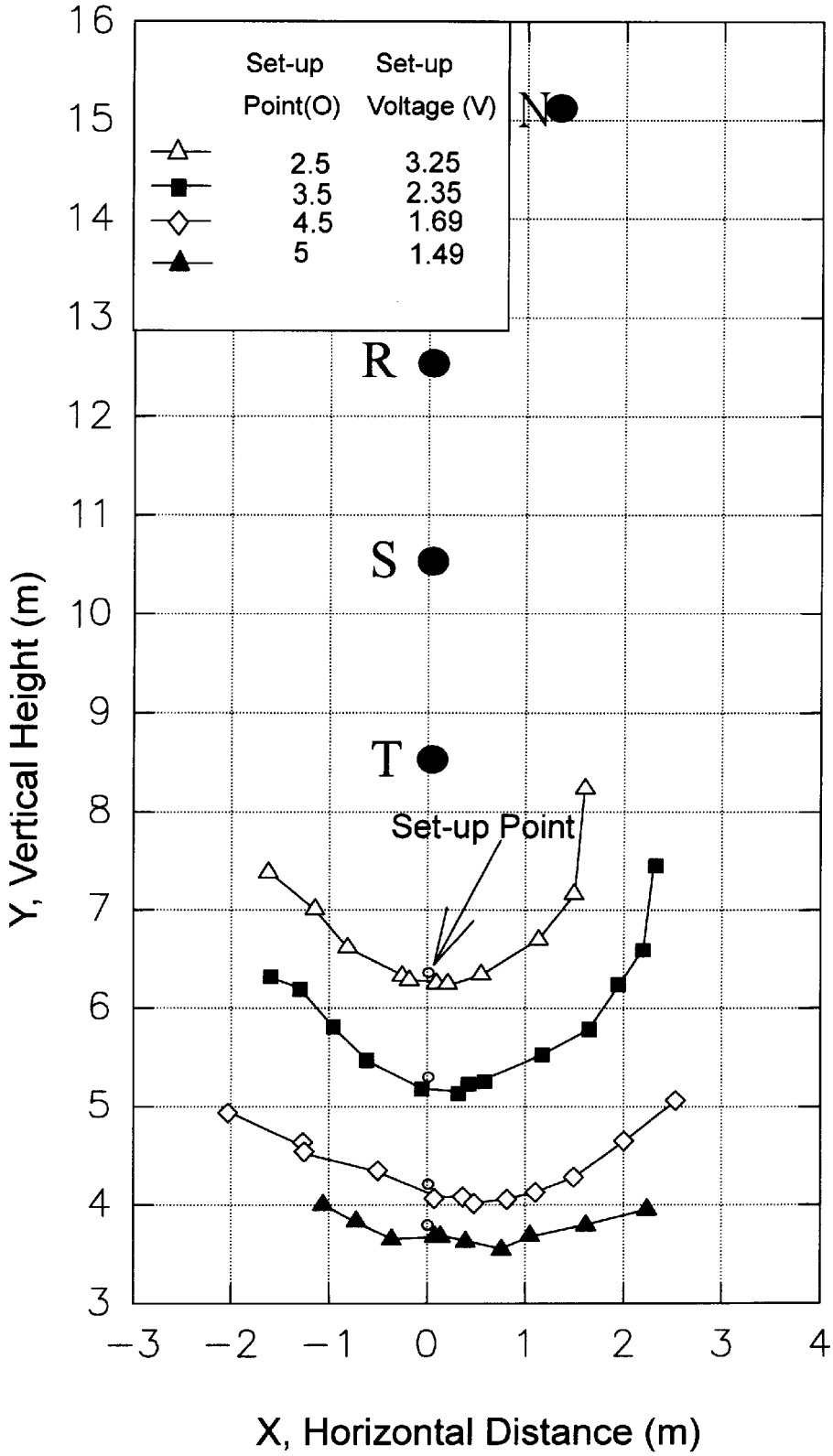

FIG. 44 shows alarm ranges of the digital alarm device of the present invention (negative feedback resistance of 1 MΩ) with various set-up points, which is contiguous to the 69 kV overhead power lines and located at the front surface of the top end of the suspension arm.

Figure 45:
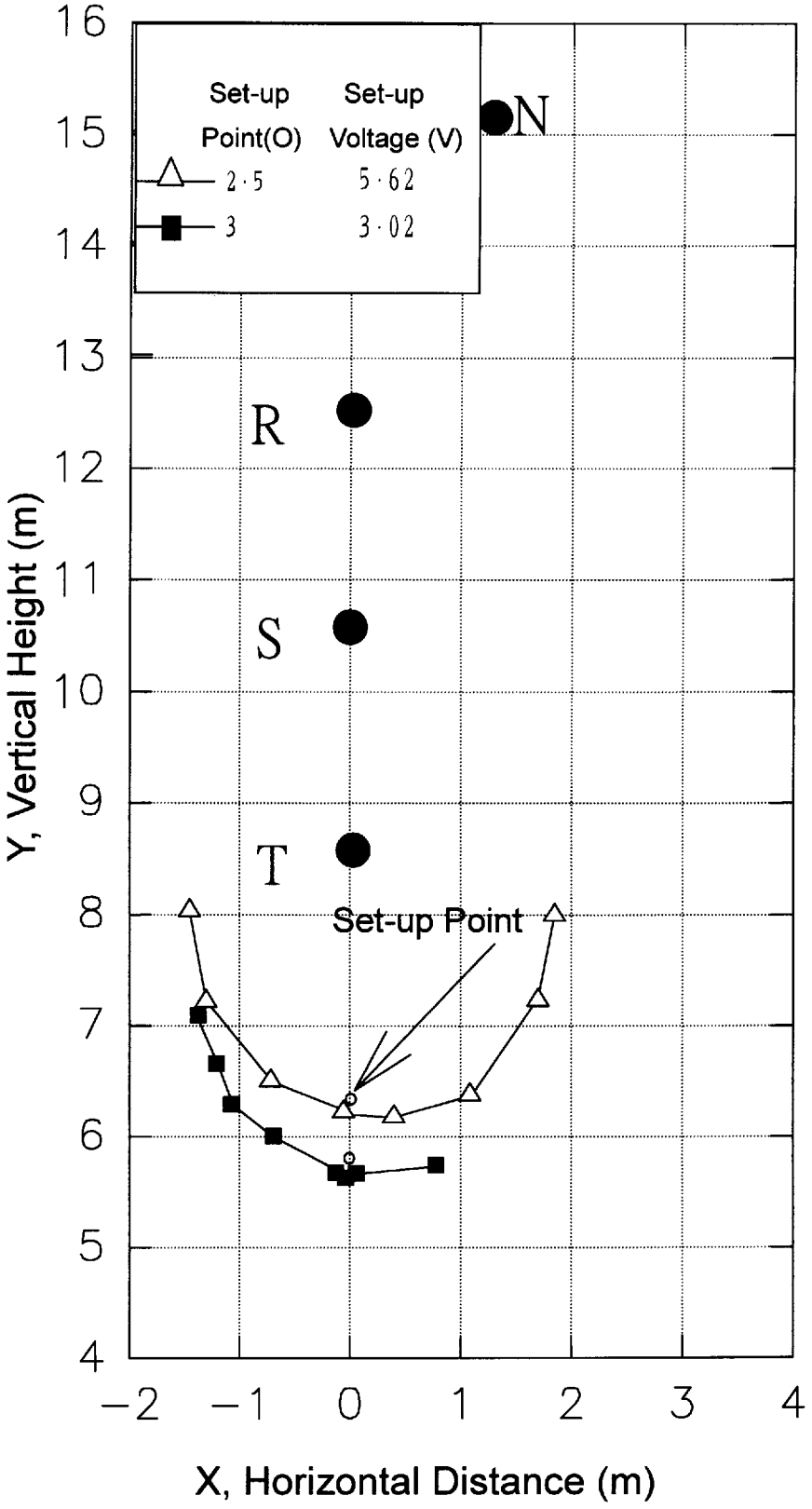

FIG. 45 shows alarm ranges of the digital alarm device of the present invention (negative feedback resistance of 2 MΩ) with various set-up points, which is contiguous to the 69 kV overhead power lines and located at the front surface of the top end of the suspension arm.

Figure 46:
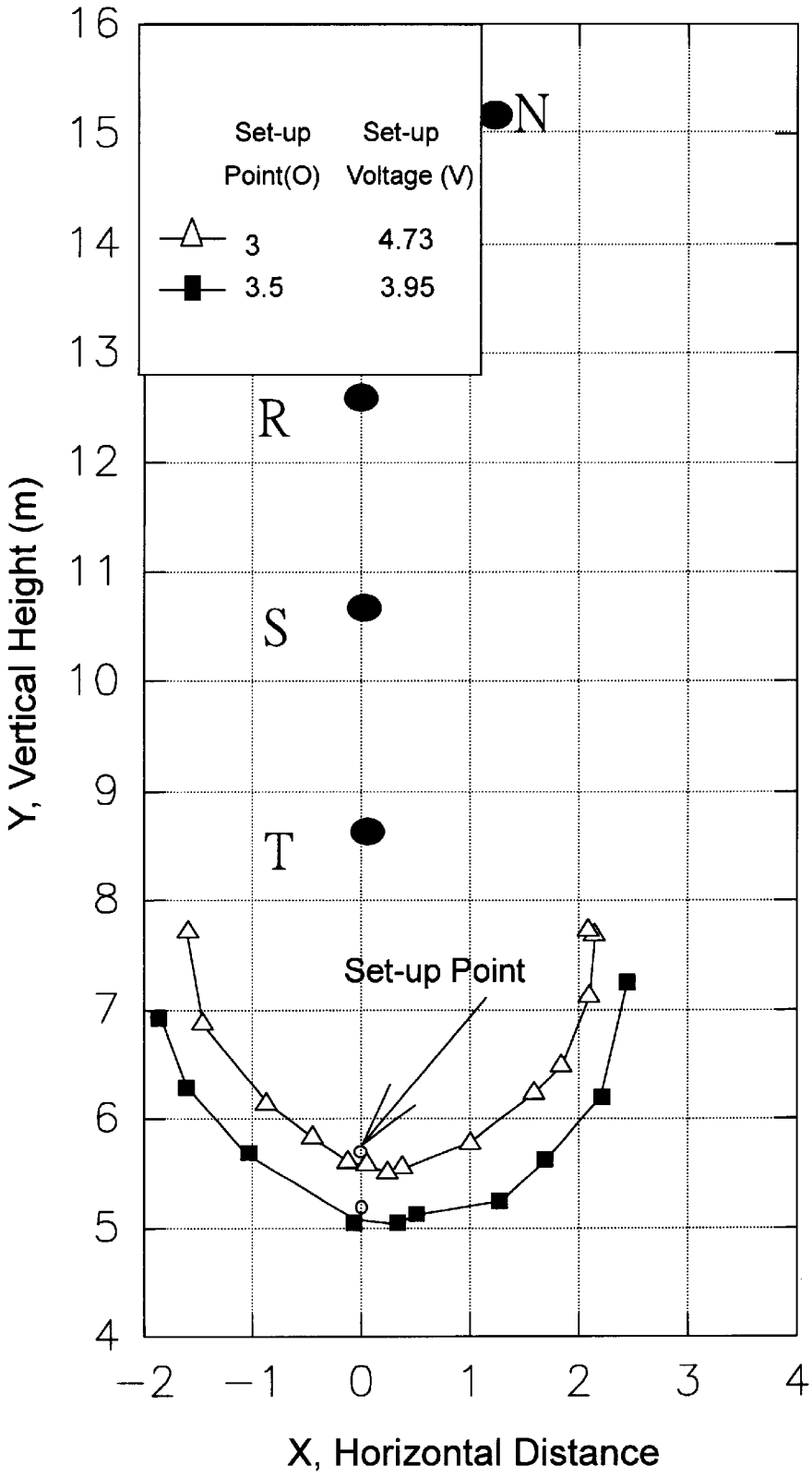

FIG. 46 shows alarm ranges of the digital alarm device of the present invention (negative feedback resistance of 3 MΩ) with various set-up points, which is contiguous to the 69 kV overhead power lines and located at the front surface of the top end of the suspension arm.

Figure 47:
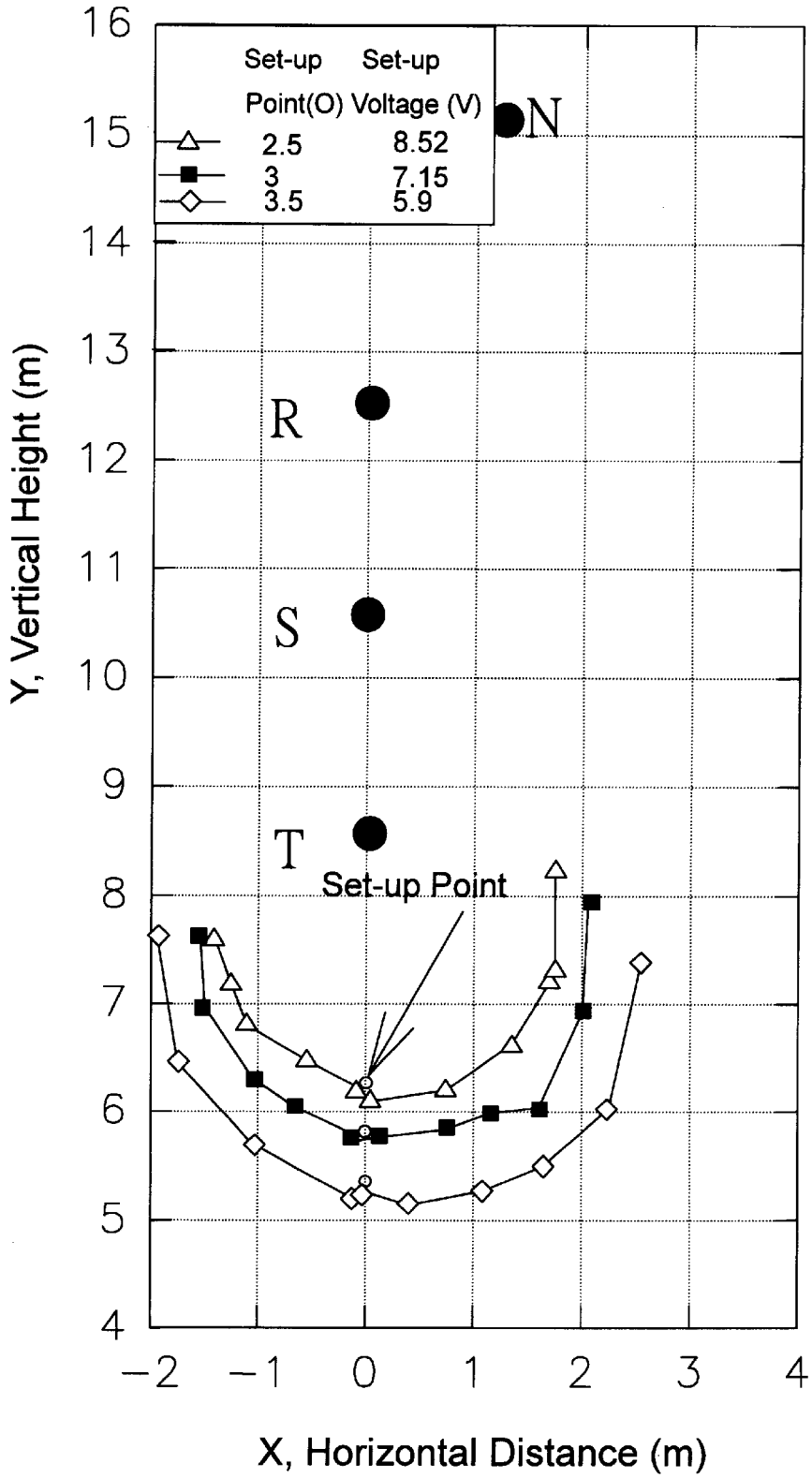

FIG. 47 shows alarm ranges of the digital alarm device of the present invention (negative feedback resistance of 4 MΩ) with various set-up points, which is contiguous to the 69 kV overhead power lines and located at the front surface of the top end of the suspension arm.

Figure 48:
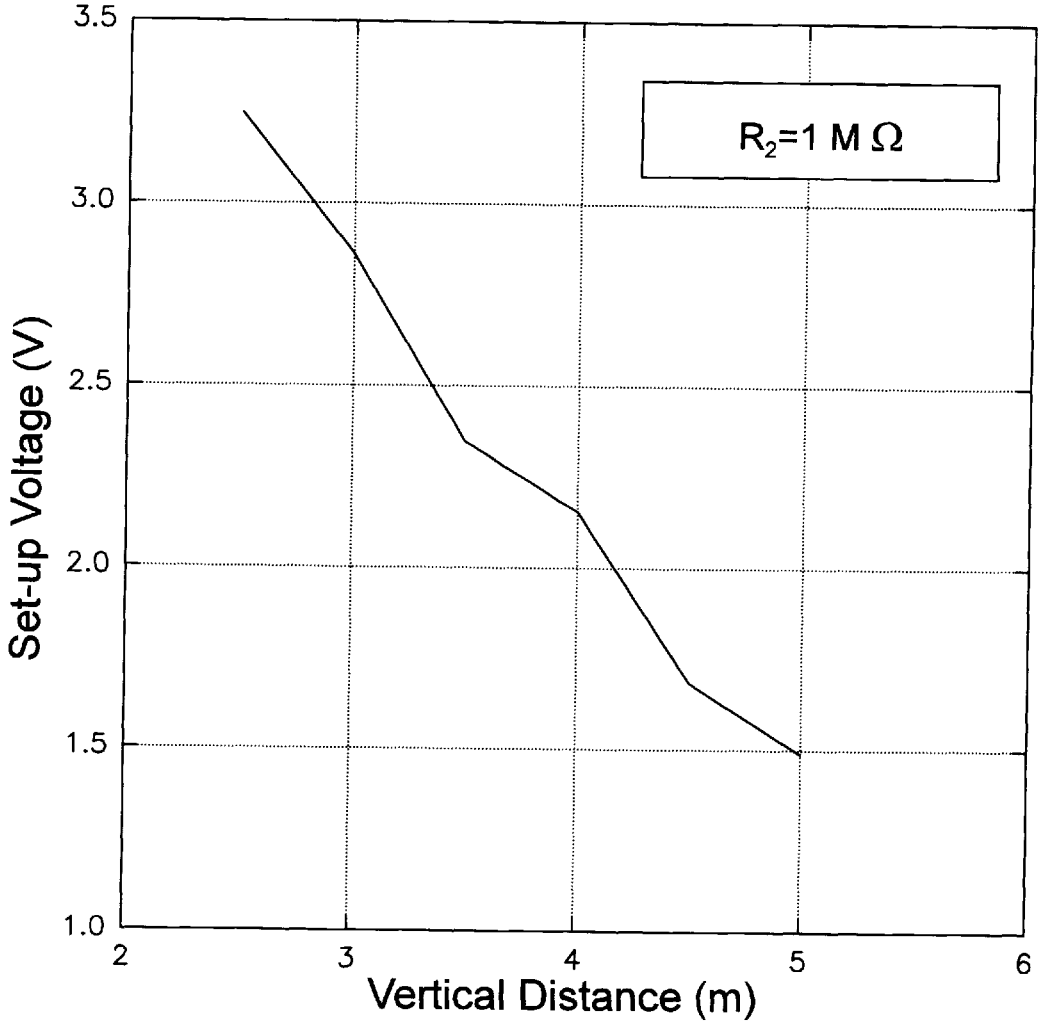

FIG. 48 is a diagram showing the relationship between the set-up voltage and the vertical distance of the digital alarm device of the present invention (negative feedback resistance of 1 MΩ) under the 69 kV overhead power lines.

DETAILED DESCRIPTION OF THE INVENTION

Figure 1:
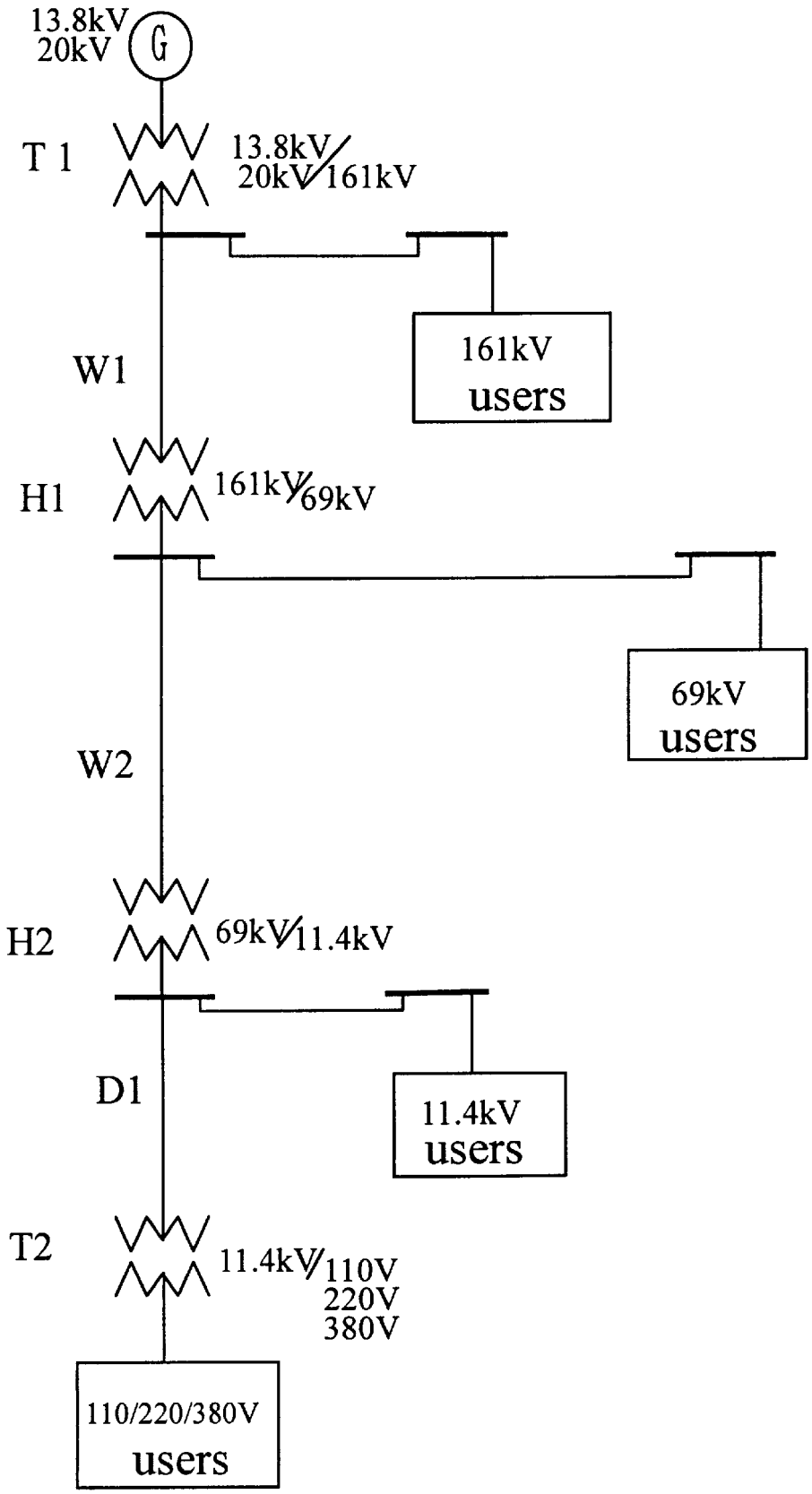
Figure 1 (PRIOR ART)
FIG. 1 shows a schematic view of a typical power transmission network.
Figure 2:
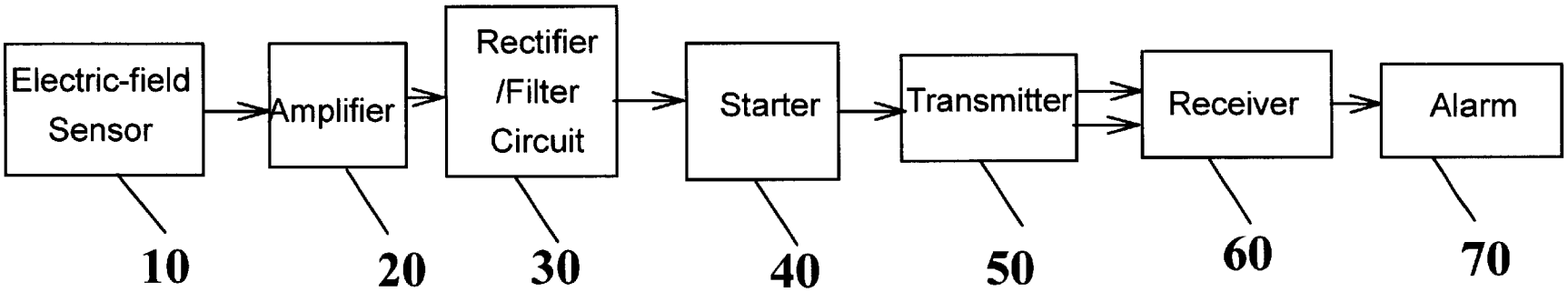
FIG. 2 shows a block diagram of a basic framework of the alarm device of the present invention.

As shown in FIG. 2, an alarm device embodied in the present invention is designed to warn of danger of hitting high voltage overhead power lines by a crane in motion. The alarm device is composed of an electric-field sensor 10, an amplifier 20, a rectifier/filter circuit 30, a starter 40, a transmitter 50, a receiver 60, and an alarm 70. The receiver 60 and the alarm 70 may be combined into a wireless receiver/alarm unit.

The electric-field sensor 10 is used to detect the alternating electric field of high voltage power lines and to output the alternating current.

The amplifier 20 is connected with the electric-field sensor 10 for amplifying the alternating current and outputting the alternating voltage.

The rectifier/filter circuit 30 is connected with the amplifier 20 for rectifying and filtering the alternating voltage, and for outputting a direct current voltage.

The starter 40 is disposed between the rectifier/filter circuit 30 and the wireless transmitter 50 for starting the wireless transmitter 50 at such time when the direct current voltage exceeds a predetermined value. Upon being started, the wireless transmitter 50 transmits a microwave signal.

The receiver 60 is intended to receive the microwave signal which is transmitted by the wireless transmitter 50. Upon having received the microwave signal, the receiver 60 sends out a signal to activate the alarm 70 such that a warning signal is brought about by the alarm 70.

Figure 3:
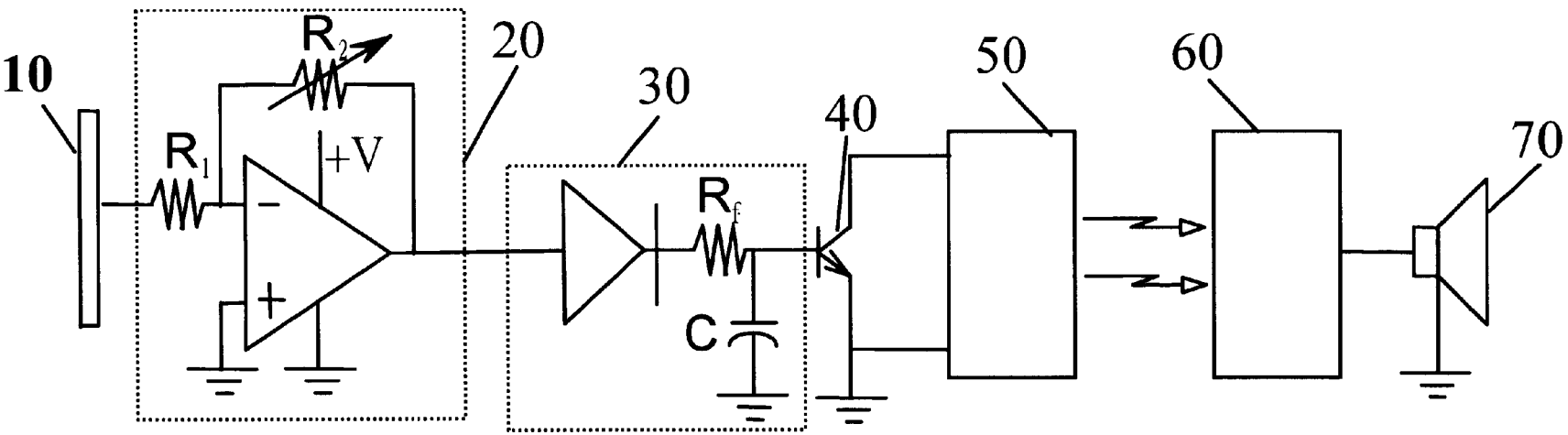
FIG. 3 shows a schematic view of a main circuit framework of the alarm device of the present invention.
Figure 4:
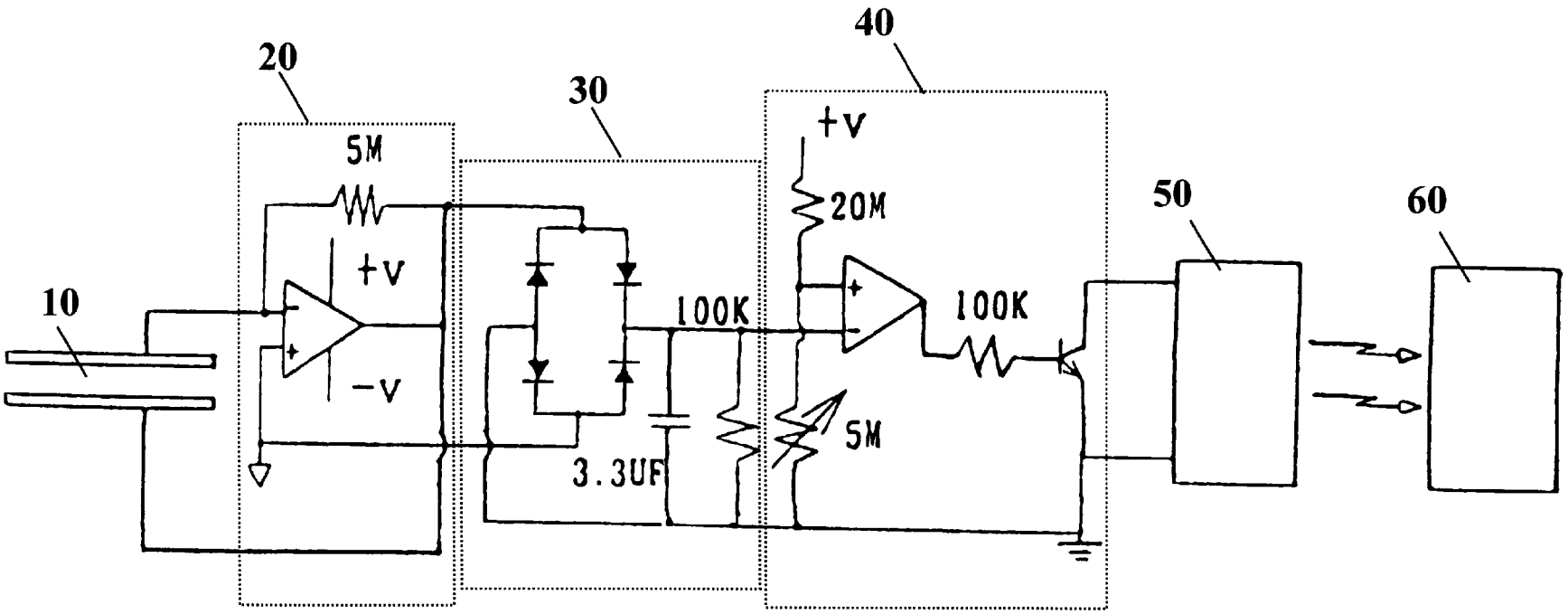
FIG. 4 shows a schematic view of another main circuit framework of the alarm device of the present invention.

As shown in FIGS. 3 and 4, the electric-field sensor 10 may be a single electric-field plate, parallel electric-field plates, or a electric-field box. The electric field sensor 10 is preferably of a boxlike construction.

The amplifier 20, the rectifier/filter circuit 30, the starter 40, and the wireless transmitter 50 can be devices known in the prior art. The wireless receiver/alarm 60, 70 may be of an analog or digital construction.

Figure 6B:
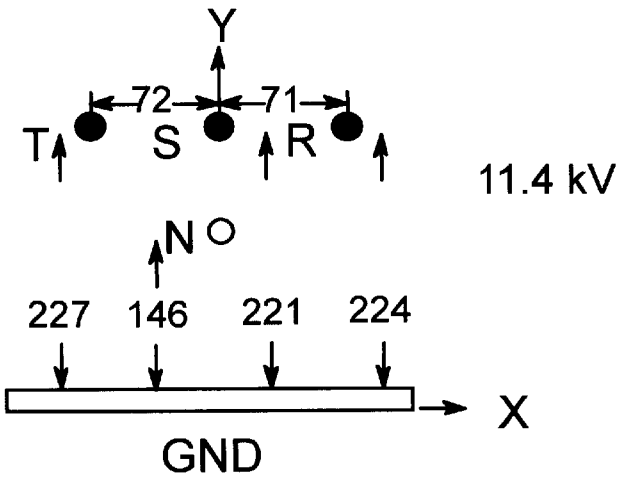
FIG. 6*b* shows a schematic view of the overhead power line distribution of the three-phase four-wire type (3ϕ4 w).
Figure 6A:
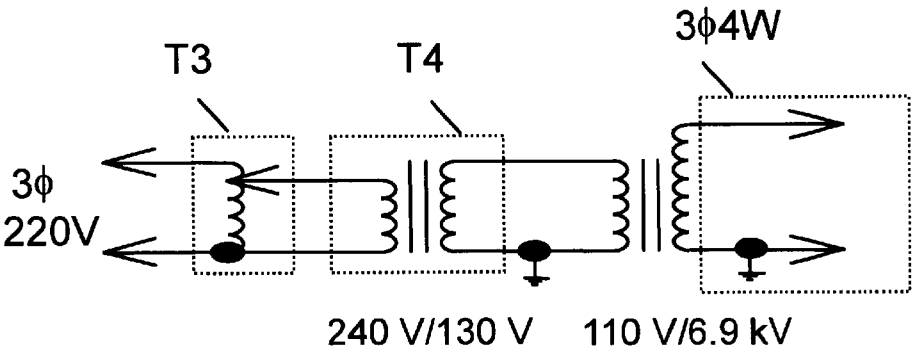
FIG. 6*a* shows a schematic view of the voltage change of the power transmission of the three-phase four-wire type (3ϕ4 w).

The reduce interference and danger in view of the involved in testing the invention under actual high voltage overhead power lines, sheathed power lines having a length of 15 meters were used to construct an overhead power distribution lines having a three-phase four wire connection (3ϕ4 w) as shown in FIGS. 6*a* and 6*b*, which could be adjusted for voltage level. The open end of the power lines did not affect the electric field distribution of the proximity of the power lines. The sheathed power lines may have had cladding different from the actual 11.4 kV high voltage overhead power lines, but the difference is insignificant as far as the surrounding electric field is concerned. As a result, the emulation is applicable to the alarm device of the present invention.

For the experiment, a power source of three-phase 220 volts was used. A three-phase auto-transformer T3 (0~240 v) was used such that the three-phase outputs of the transformer T3 were connected with the high voltage sides of three sets of single-phase fixed winding transformers T4 (240 v/130 v). The 240 v high voltage sides of the transformers T4 formed a delta Δ connection. The 130V low voltage sides were connected by four wires to form the Y connection of the three-phase four-wire connection (3ϕ4 w). In order to avert the effect of the floating of the ground electric potential on the personnel and the machinery of the experiment, and to conform to the actual method of connecting the overhead power lines by the local power company, the neutral point N of the Y connection line of the three-phase four-wire connection was connected to the common grounding point GND of the equipment of the laboratory. By using this measure, the electric potential of the neutral line was kept consistent with the ground zero electric potential and safety was enhanced. As shown in FIG. 6*b*, T, S, and R are respectively the phases conductors of three-phases of the overhead power distribution lines of the three-phase four-wire connection of the Y connection. Finally, they were connected with a three-phase 110 v/11.4 kV transformer (not shown in the drawing), so as to raise the voltage level to 11.4 kV and apply to no load overhead power distribution lines of the three-phase four-wire connection. The overhead power line network was thus completed for the experiment. As shown in FIG. 6*b*, the numerals represent respectively the distances (cm) in X and Y directions.

In the experiment, a voltage meter was connected between the low-voltage-side lines of the three-phase transformer. In the meantime, the auto-transformer was adjusted such that the reading of the voltage meter was 110V, thereby enabling the no load overhead power lines to have the voltage up to 11.4 kV. In addition, this framework allowed the adjustment of voltage level of the output end, so as to emulate other overhead power line frameworks of various voltage levels.

Figure 7:
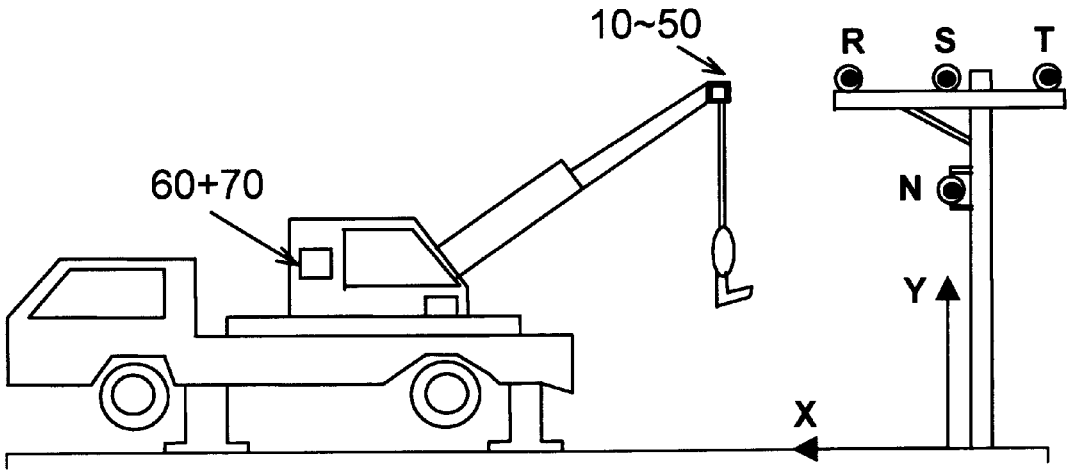
FIG. 7 shows a schematic view of the alarm device mounted on a crane.

The alarm device of FIG. 2 is embodied in FIGS. 3 and 7, in which the electric-field sensor 10, the amplifier 20, the rectifier/filter circuit 30, the starter 40, and the transmitter 50 are mounted on the suspension arm. The receiver 60 and the alarm 70 are located in the control room. The electric-field sensor 10 at the leftmost side of the circuit in FIG. 3 is a single polar piece. By using the electric-field sensor of the single polar piece to approach the power lines, a 60 Hz $\mu$A alternating current was induced on the metal surface of the electric-field sensor by the influence of the 60 Hz alternating electric field of the power line. The current was introduced into the (−) input terminal of the negative feedback operational amplifier, thereby forming an input voltage, which was amplified by the operational amplifier to output the 60 Hz voltage. The switching function of the starter 40 is realized by a transistor which needs a direct current to start the transmitter 50. As a result, the output voltage of the operational amplifier was rectified via a diode and then connected to a resistor-capacitor charge-discharge filtering circuit, so as to provide the starter 40 with a more stable direct current voltage from the capacitor. When the detected current of the electric-field sensor 10 exceeds a predetermined value, a large enough direct current voltage is brought about to enable the starter 40, thereby causing the transmitter 50 to transmit a microwave signal, which is then picked up by the receiver 60. The receiver 60 upon receipt of the microwave signal is capable of driving the alarm 70, which is located in the control room, to bring about the warning buzz. In the experiments, we use the remote control alarm device commercially available for a motorcycle as the alarm 70.

Figure 5:
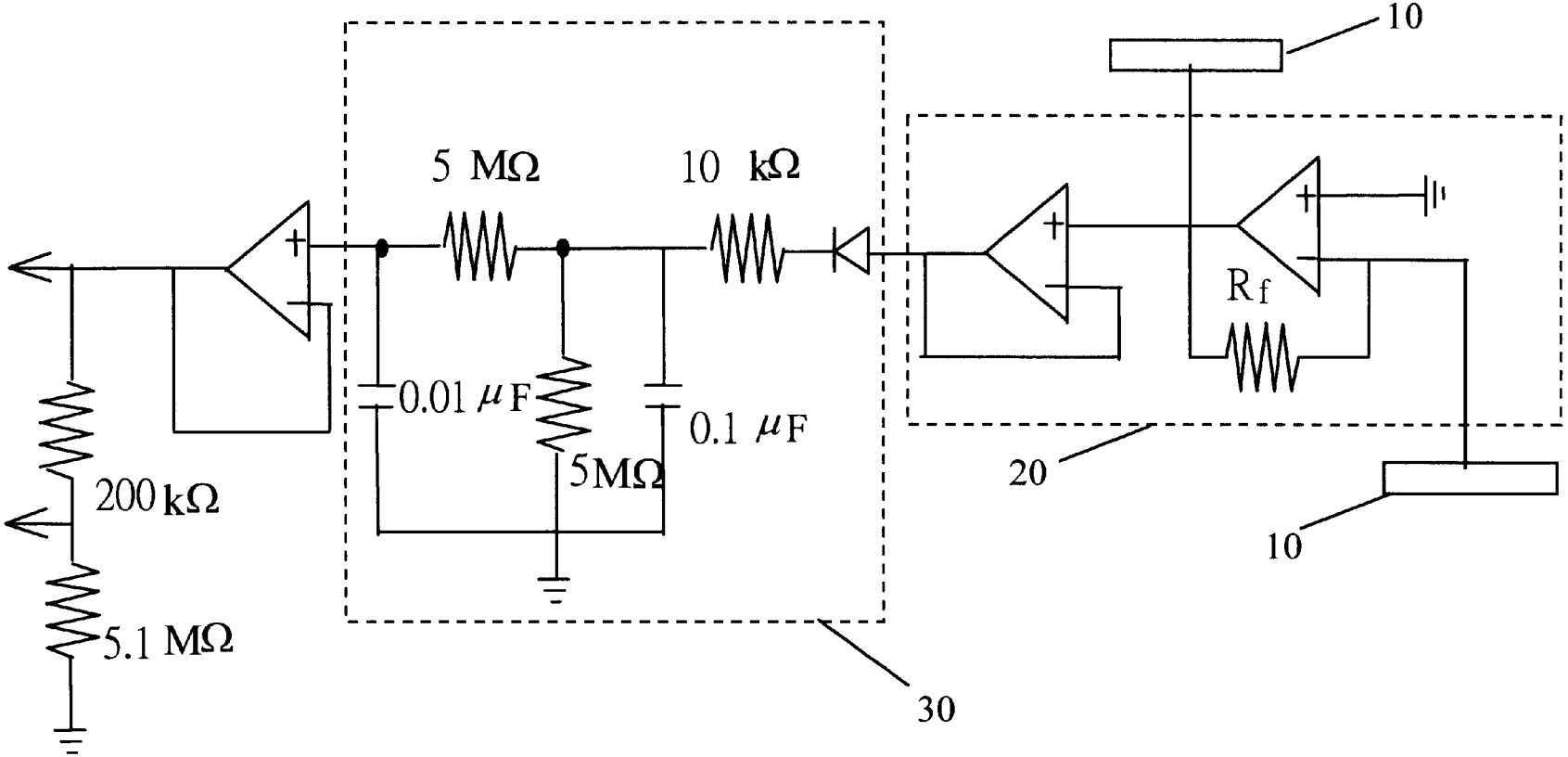
FIG. 5 shows a schematic view of still another main circuit framework of the alarm device of the present invention.

As shown in FIGS. 4 and 5, the alarm device of the present invention is embodied such that the electric-field sensor 10 is of a parallel design, which is different from that of FIG. 3. The rectifier/filter circuit 30 of FIGS. 3, 4 and 5 are also different from one another. The components having the same functions are denoted by the same reference numerals.

Figure 8:
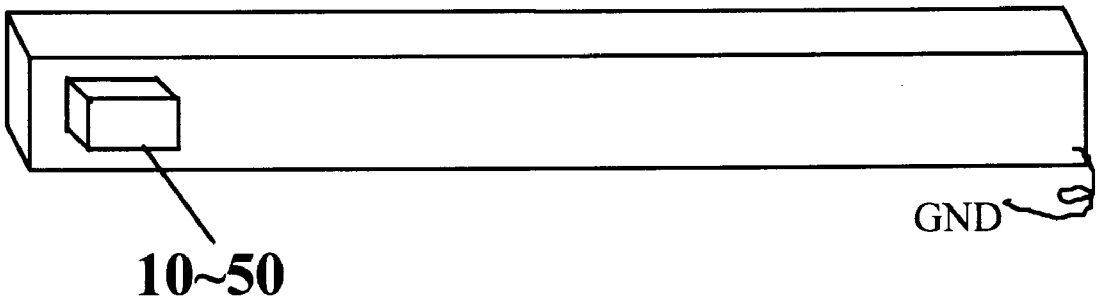
FIG. 8 shows a schematic view of the alarm device mounted on an emulating suspension arm.

In order to emulate the actual working conditions of the metal suspension arm, the elements 10–50 of the alarm device were mounted on the side surface of one end of a metal rectangular suspension arm (156 cm×8.5 cm×17.6 cm). Another end is grounded (GND), as shown in FIG. 8. The design of the present invention is centered on the sensitivity of the alarm device. The experiment was carried out to test the sensitivity factors, which include the direction of the electric-field plate, the set-up of the amplifying gain, the grounding or not grounding of the emulated suspension arm, the size of the electric-field plate, and the distance between the electric-field plate and the suspension arm, etc. The results are described hereinafter.

The electric-field plate is related to the direction of the power lines and the moving direction of the movable suspension arm of a crane. The effect of the electric-field plate on the sensitivity of the alarm device of the present invention is shown in Table 1, in which the data of X-axis and Y-axis denote the positions of the electric-field plate at the time when the alarm device buzzed. The suspension arm was perpendicular to the ground. The electric-field plate was forward, sideways, and reverse in relation to the power lines. When the electric-field plate faces the power lines, the sensitivity of the alarm device is the highest. When the electric-field plate faces the direction opposite to the power lines, the sensitivity of the alarm device is the lowest but still effective. The following measurements were taken sideways to evaluate the effect of other factors on the sensitivity.

Figure 9:
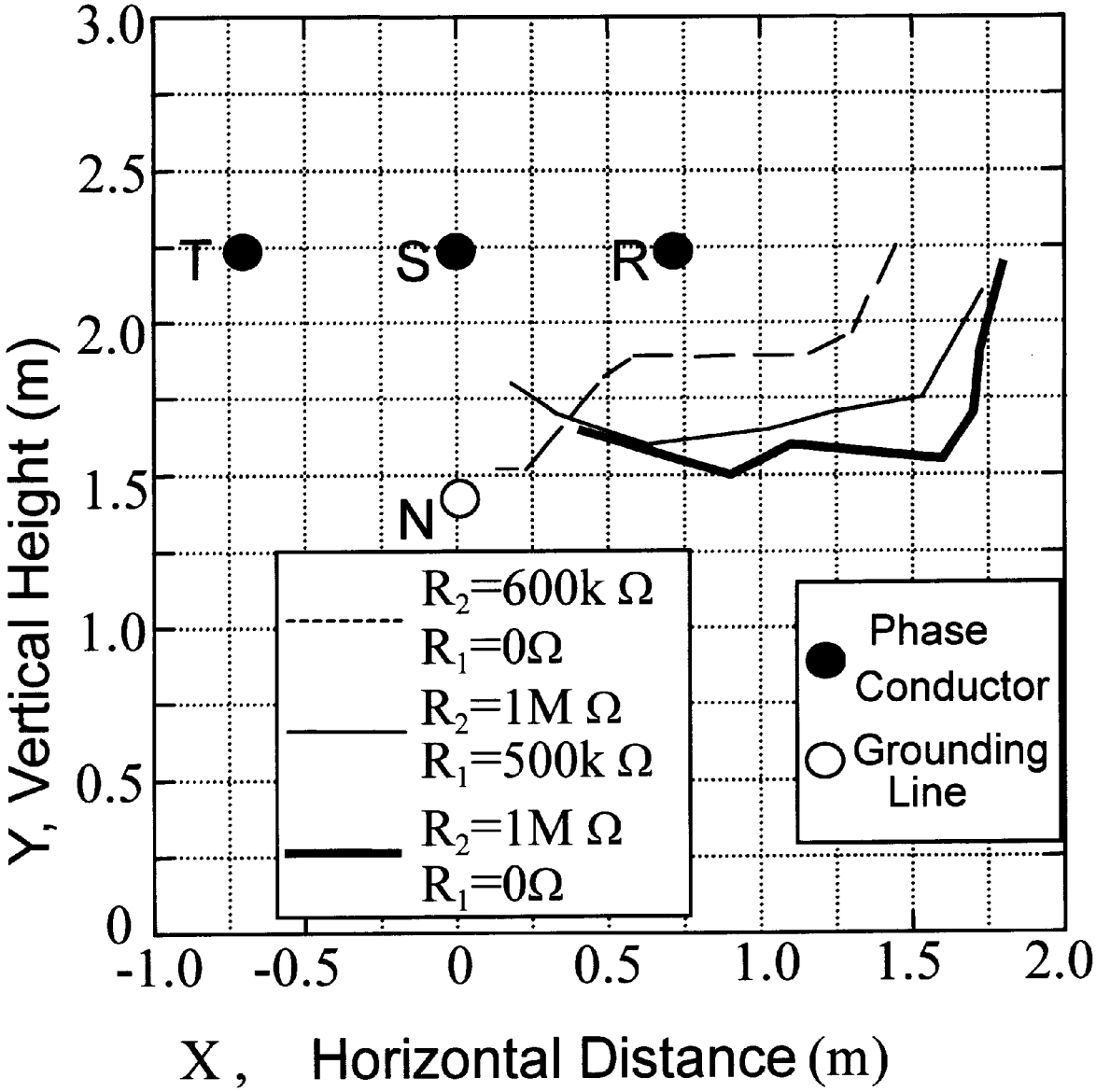
FIG. 9 shows a diagram of the effect of the amplifier gain of the alarm device of the present invention on the trigger position of the alarm device.
Figure 10:
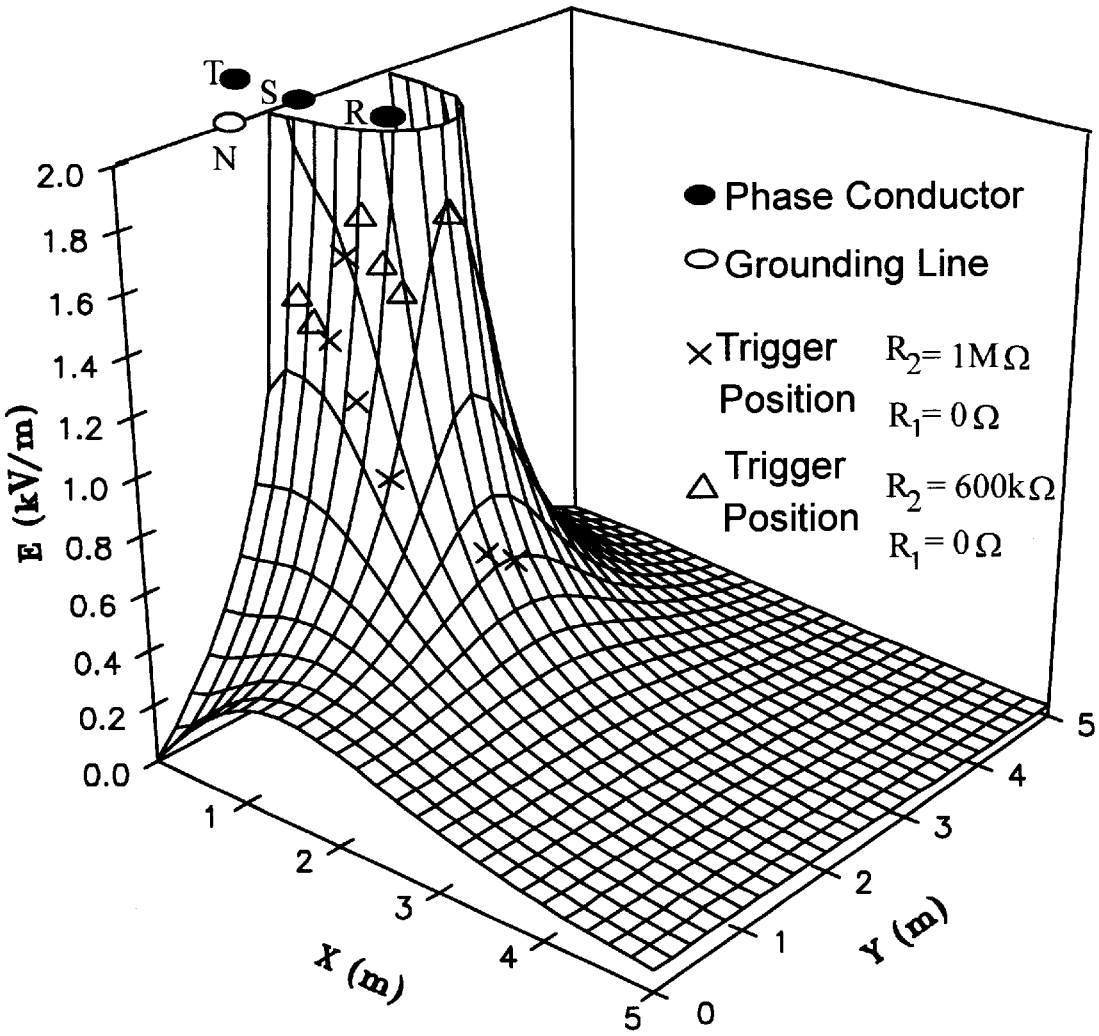
FIG. 10 shows a schematic view of the trigger position of the alarm device of the present invention and the electric field intensity.

Table 2 and FIG. 9 show the relationship between the amplifier gain and the alarm trigger position. FIG. 10 shows the electric field intensity of the trigger position of various gains. In Table 2, FIGS. 9 and 10, the alarm device of the present invention used has the circuitry of FIG. 3.

The negative feedback resistance $R_2$ of FIG. 3 can effectively control the sensitivity of the alarm device.

Figure 11:
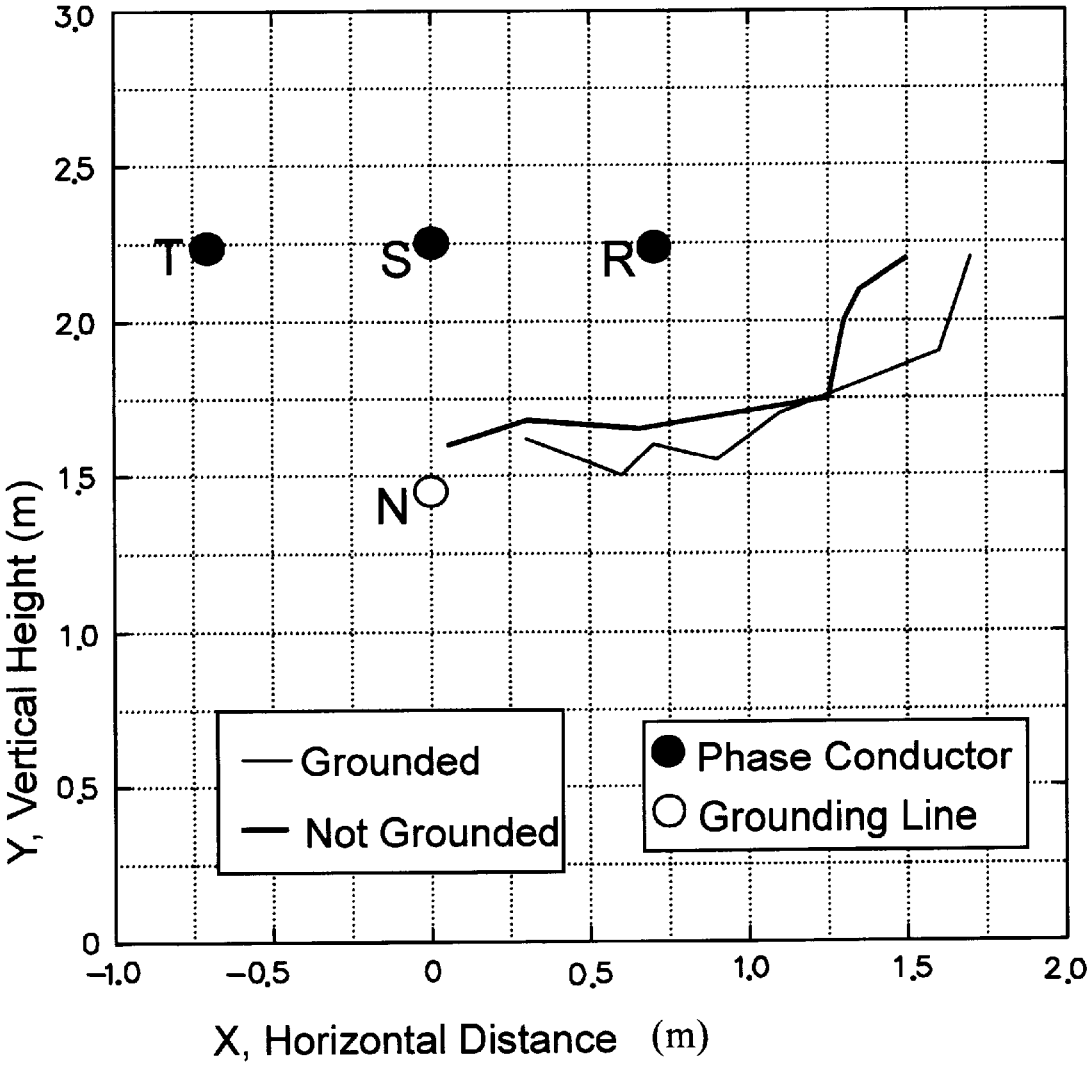
FIG. 11 shows a diagram of the effect of grounding of the suspension arm on the trigger position of the alarm device of the present invention.
Figure 12:
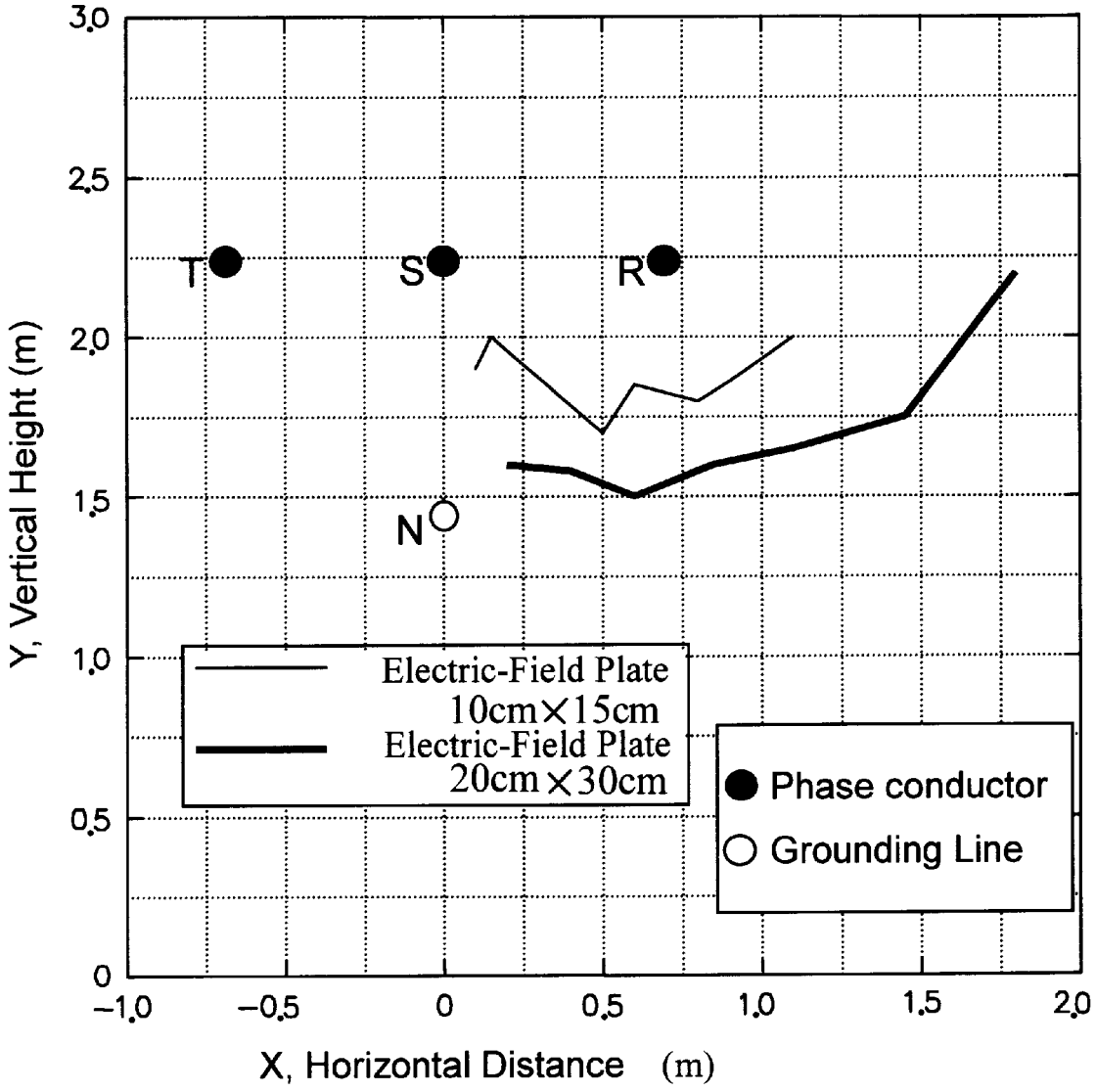
FIG. 12 shows a diagram of the effect of the size of the electric-field plate on the trigger position of the alarm device of the present invention.
Figure 13:
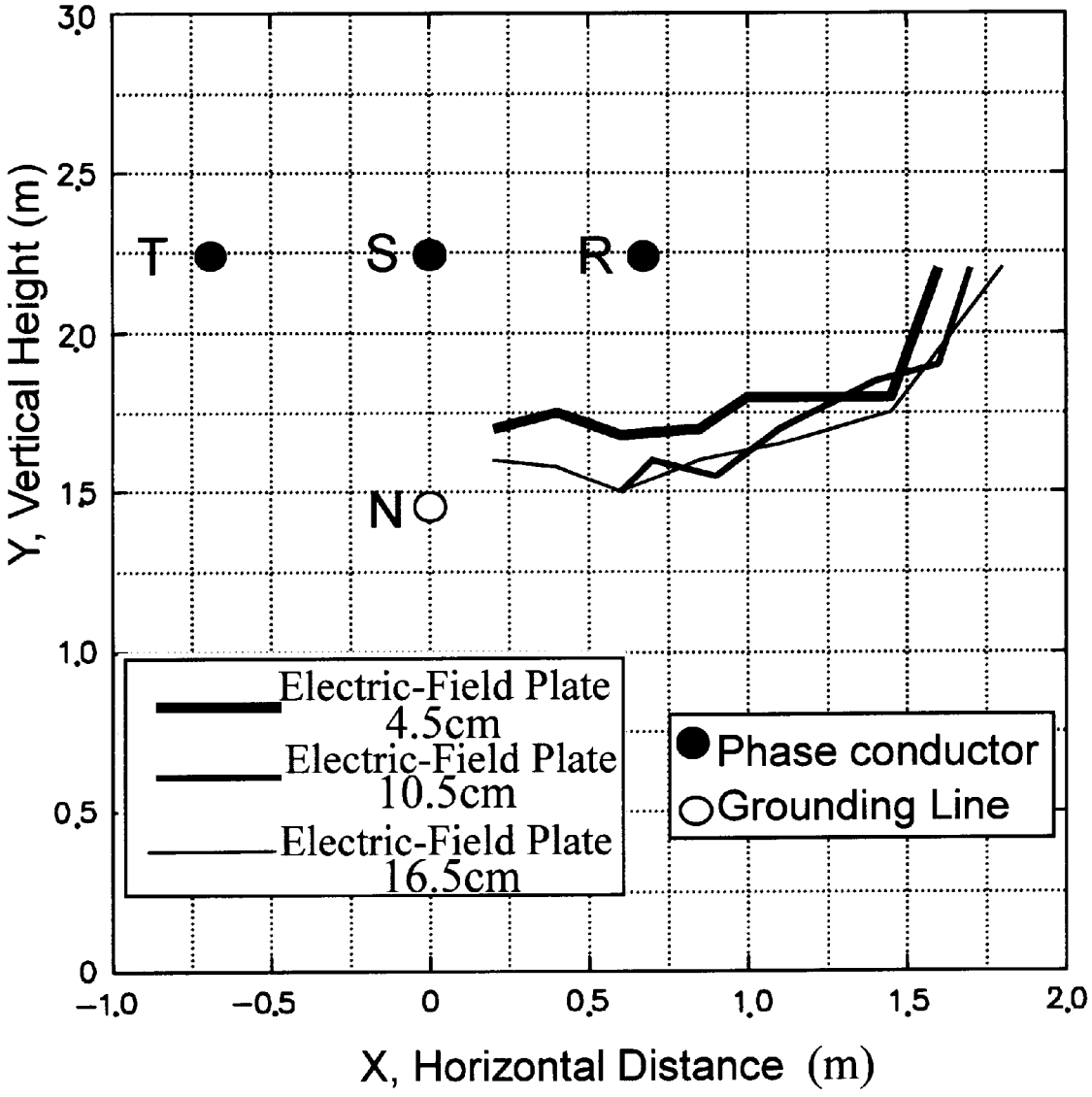
FIG. 13 shows a diagram of the effect of the distance between the electric-field plate of the alarm device of the present invention and the surface of the metal suspension arm on the trigger position of the alarm device.

Table 3 and FIG. 11 show the effect of the grounding of the metal suspension arm on the alarm sensitivity of the alarm device having the circuitry of FIG. 3. The suspension arm which is grounded is more sensitive than the suspension arm which is not grounded. This is due to the fact that the grounded metal body has a stronger surface vertical electric field intensity. However, whether the crane is well grounded or not matters little. Table 4 and FIG. 12 show the corresponding relationship between the size of the electric-field plated and the alarm sensitivity. The electric-field plate has two sizes, which are 20 cm×30 cm and 10 cm×15 cm. The greater the size of the electric-field plate is, the greater the total induced electric charge is. As a result, the electric-field plate of a greater size has a greater sensitivity and a greater alarm range. Table 5 and FIG. 13 show the relationship between the sensitivity and the distance between the electric-field plate and the surface of the metal suspension arm. The distances are 4.5 cm, 10.5 cm, and 16.5 cm. The greater the distance is, the greater the electric field intensity of the electric-field plate is. As a result, the sensitivity is greater. However, these three distances show little difference in the effect. In the practical application, the electric-field plate should be located as close as possible to the crane body to avert the projection of the alarm device to obstruct the mobility of the crane.

TABLE 1

Effect of electric-field plate direction on trigger position

| Vertical forward direction | | Vertical side direction | | Vertical reverse direction | |
|---|---|---|---|---|---|
| X-axis | Y-axis | X-axis | Y-axis | X-axis | Y-axis |
| 205 cm | 220 cm | 160 cm | 220 cm | 140 cm | 220 cm |

TABLE 2

Effect of amplifier gain on trigger position

| R2 = 1MΩ, R1 = 500KΩ | | R2 = 1MΩ, R1 = 0KΩ | | R2 = 600KΩ, R1 = 0KΩ | |
|---|---|---|---|---|---|
| X-axis (m) | Y-axis (m) | X-axis (m) | Y-axis (m) | X-axis (m) | Y-axis (m) |
| 1.70 | 2.10 | 1.80 | 2.20 | 1.20 | 2.20 |
| 1.50 | 1.75 | 1.70 | 1.90 | 0.95 | 1.75 |
| 1.20 | 1.70 | 1.20 | 1.70 | 1.10 | 1.95 |
| 1.00 | 1.65 | 0.90 | 1.55 | 0.80 | 1.70 |
| 0.60 | 1.60 | 0.70 | 1.60 | 0.60 | 1.60 |
| 0.30 | 1.70 | 0.60 | 1.50 | 0.50 | 1.50 |
| 0.15 | 1.80 | 0.30 | 1.65 | 0.20 | 1.50 |

TABLE 3

Effect of grounding on trigger position

| Grounded | | Not grounded | |
|---|---|---|---|
| X-axis (m) | Y-axis (m) | X-axis (m) | Y-axis (m) |
| 1.70 | 2.20 | 1.50 | 2.20 |
| 1.60 | 1.90 | 1.35 | 2.10 |
| 1.10 | 1.70 | 1.30 | 2.00 |
| 0.90 | 1.55 | 1.25 | 1.75 |
| 0.70 | 1.60 | 0.65 | 1.65 |
| 0.60 | 1.50 | 0.30 | 1.68 |
| 0.30 | 1.62 | 0.05 | 1.60 |

TABLE 4

Effect of size of electric-field plate on trigger position

| Electric-field plate size 20 cm × 30 cm | | Electric-field plate size 10 cm × 15 cm | |
|---|---|---|---|
| X-axis (m) | Y-axis (m) | X-axis (m) | Y-axis (m) |
| 1.80 | 2.20 | 1.10 | 2.00 |
| 1.45 | 1.75 | 0.90 | 1.85 |
| 1.10 | 1.65 | 0.80 | 1.80 |
| 0.85 | 1.60 | 0.60 | 1.85 |
| 0.60 | 1.50 | 0.50 | 1.86 |
| 0.40 | 1.58 | 0.15 | 2.00 |
| 0.20 | 0.60 | 0.10 | 1.90 |

TABLE 5

Effect of distance between electric-field plate and metal suspension arm surface on trigger position

| Interval 4.5 cm | | Interval 10.5 cm | | Interval 16.5 cm | |
|---|---|---|---|---|---|
| X-axis (m) | Y-axis (m) | X-axis (m) | Y-axis (m) | X-axis (m) | Y-axis (m) |
| 1.60 | 2.2 | 1.70 | 2.20 | 1.80 | 2.20 |
| 1.45 | 1.80 | 1.60 | 1.90 | 1.45 | 1.75 |
| 1.00 | 1.80 | 1.40 | 1.85 | 1.10 | 1.65 |
| 0.85 | 1.70 | 1.10 | 1.70 | 0.85 | 1.60 |
| 0.60 | 1.68 | 0.90 | 1.55 | 0.60 | 1.50 |
| 0.40 | 1.75 | 0.70 | 1.60 | 0.40 | 1.58 |
| 0.20 | 1.70 | 0.60 | 1.50 | 0.20 | 1.60 |

FIGS. 2–5 show the alarm device of a fixed resistance type. Upon having been made, the alarm device has an alarm range which can not be adjusted. The present invention discloses another alarm device having a remote control set-up function. The alarm device has an alarm range which can be set up in-situ by a remote control.

(A) The test of mean-value analog type remote setting alarm device:

The integral circuit of the mean-value analog type remote setting alarm device is shown in FIG. 14. The rectifier/filter design uses a mean-value sampling mode. That is to say that the signal sampled is converted from the positive half cycle sine wave into the stable direct current voltage of 0.318 times the sine wave peak value. The principle and operation of the circuit action are described hereinafter.

A preset button K is first pressed such that the voltage level on a memory capacitor ($10^4$ $\mu$F) is charged to the voltage of +5V. As a result, the maximum mean value of the positive half cycle sine wave is about 2.55 volts (0.318 times the 8 volts sine wave peak value). Before setting up, the voltage detected by the circuit is lower than the electric potential of the memory capacitor ($10^4$ $\mu$F). As a result, the wireless transmitter 50 of the circuit does not act by mistake to cause the receiver 60 and the alarm 70 of FIG. 2 to produce the alarm buzz. In addition, a receiver 90 for remote setting is prevented from interfering by the wireless transmitter 50.

When the above circuit is moved to an appropriate position, the operator presses a setting switch of a transmitter for remote setting such that an IC relay 93 of the circuit is activated remotely, and the connection point of the relay is connected. The flowing electric charge detected by the electric-field plate 10 forms a direct current voltage on the 0.1 $\mu$F tantalum capacitor via a current-voltage conversion amplifier 20 and the rectifier/filter circuit 30. The circuit setting is then completed by storing the sampled voltage in the $10^4$ $\mu$F memory capacitor via a voltage follower 91.

When the induced voltage of the circuit is higher than the voltage of the memory capacitor ($10^4$ $\mu$F), the operational amplifier 92 of the final grade is driven such that the starter (transistor) 40 is activated, and the wireless transmitter 50 in the circuit device is driven to act by the characteristic of the saturation area of the transistor, thereby resulting in the buzzing of the receiver 60 and the alarm 70 of FIG. 2.

An alarm device having the mean value analog remote setting circuit of FIG. 14 is tested on the site having 11.4 kV overhead power distribution lines of FIG. 15. The results are shown in FIGS. 16–18. The circuit is disposed on the highest end of the suspension arm of the crane of FIG. 15. The highest end of the suspension arm was moved on a plane defined by x-axis and height (Y-axis). The set-up points of FIGS. 16–18 were set up by using the remote control, at which the alarm was triggered by the circuit. FIGS. 16–18 show positions of the highest end of the suspension arm of the crane where the circuit would trigger the alarm of the wireless receiver/alarm after the set-up points were set up. The test results show that the mean value analog remote setting alarm device has the function of remote setting of the alarm range. As a result, the alarm range can be set up by changing the set-up points, even at the position right under the overhead power lines having the weakest electric field strength.

(B) The test of peak-value analog type remote setting alarm device FIG. 19 shows a circuitry of a peak-value analog type remote setting alarm device. The elements and the units similar in function to those of FIG. 14 are denoted by the similar reference numerals. The voltage level obtained by the peak-value sampling mode is higher than the voltage level obtained by the mean-value sampling mode. The alarm device is therefore affected little by the voltage change of the memory capacitor ($10^4$ $\mu$F). In addition, the discharge path is designed to be a serial connection of 510 KΩ and 5.1 MΩ resistances. This 10:1 ratio of resistance enables the voltage value of the memory capacitor ($10^4$ $\mu$F) to be set lower than the actual voltage value detected by the alarm device, thereby causing the comparator to act to drive the final grade transistor (starter 40) so as to bring about the buzzing by the alarm. As a result, the completion of setting is made sure and a pre-work testing of the alarm device is possible.

The test conditions of the test site of the peak value analog remote setting alarm device are shown in FIG. 20, with the results being shown in FIGS. 21–24. FIG. 21 shows the corresponding relationship between the vertical distance under the S phase conductor of the 11.4 KV overhead power lines and the set-up voltage of the memory capacitor. FIGS. 22–24 show the alarm ranges of various set-up points, in which FIGS. 22 and 23 show the results of the circuit which is disposed on the highest end of the suspension arm, and FIG. 24 shows the results of the circuit disposed in the proximity of the midpoint of the suspension arm of the crane of FIG. 20. The test conditions of the 69 KV power transmission lines are shown in FIG. 25, with the results being shown in FIGS. 26–27. FIG. 26 shows the corresponding relationship between the set-up voltage of the memory capacitor and the vertical distance between the 69 KV power transmission lines and the circuit located under the 69 KV power transmission lines. FIG. 27 shows the alarm ranges when (A) the set-up point is located 3 m right under the 69 KV power transmission lines and (B) when the set-up point is located 4 m under the 69 KV power transmission lines. Even though the wireless transmitter 50 and the remote control setting circuit interfere with each other, the set-up points are very close to the trigger positions of the alarm device. The voltage of the memory capacitor tends to rise, thereby causing the set-up points to be located outside the alarm range. FIG. 28 shows the voltage of the memory capacitor relative to time. It can be seen from FIG. 28 that in a test, which lasts for 8 hours, the voltage of the memory capacitor rose by about 12%. As a result, the alarm range should become smaller (possibly approaching 30 cm).

(C) The test of digital type remote setting alarm device:

The alarm device of the present invention can be also formed of the digital technology. The digital alarm device of the present invention is composed of a digital memory unit circuit instead of the memory capacitor for storing the voltage level. A sampled analog signal is first converted into the 8-bit digital signal by an analog-to-digital converter. The digital signal is then converted into the analog output signal by a digital-to-analog converter. The set-up voltage can be thus stabilized for overcoming the drawback of the voltage instability of the memory capacitor of the analog type remote setting alarm device. FIG. 29 shows a block diagram of the voltage memory unit of the digital alarm device of the present invention.

The voltage memory unit circuit of the digital alarm device of the present invention is shown in FIG. 30. The analog-to-digital converter is IC AD 7574. IC AD7574 is a low-cost 8-bit CMOS integrated circuit, with the power consumption being only 30 mW. It is more energy efficient than a TTL integrated circuit. Its range of convertible voltage is 0–10V, which meets the requirement of the alarm device of the present invention. When IC AD 7574 is activated, the element can set the voltage at the maximum value (11111111), that is 10 volts. In addition, IC AD 7574 converts the analog into the 8-bit digital data, with the precision as high as $(2^{-8})\times$Vref. The Vref is 10 volts. The resolution of the alarm device of the present invention can reach 0.039V.

IC AD 7574 is used in conjunction with an 8-bit digital-to-analog converter IC AD 558 of a CMOS integrated circuit. The power consumption of this CMOS integrated circuit is only 75 mW without the clock signal to assist the decoding. When the power source voltage of IC AD 558 is between 11.4V and 16.5V, its output voltage is between 0 v and 10 v.

The drive signals of IC AD 7574 and IC AD 558 are generated by IC 74121. This drive signal generator circuit is shown in FIG. 31. IC 74121 gives rise to a low potential signal having a period of 200 $\mu$s via a negative edge trigger signal. The function table of IC 74121 is shown in Table 6, from which it is known that MODE5 is chosen for the purpose. At the instantaneous moment when the switch (IC RELAY D2A05) is closed, an oscillatory phenomenon is brought about. In order to present the oscillatory phenomenon from being used erroneously as the trigger signal, IC7414 is used, in which the erroneous signal of the oscillatory phenomenon is filtered out by means of a capacitor and buffer.

TABLE 6

Function table of IC74121

| Input | | | | Output | |
|---|---|---|---|---|---|
| MODE | A1 | A2 | B | Q | Q |
| 1 | L | X | H | L | H |
| 2 | X | L | H | L | H |
| 3 | X | X | L | L | H |
| 4 | H | H | X | L | H |
| 5 | H | ↑ | H | ⎍ | ⎎ |
| 6 | ↑ | H | H | ⎍ | ⎎ |
| 7 | ↑ | ↑ | H | ⎍ | ⎎ |
| 8 | L | X | ↓ | ⎍ | ⎎ |
| 9 | X | L | ↓ | ⎍ | ⎎ |

In view of the fact that it takes 15 $\mu$s for IC AD7574 to convert a batch of 8-bit data, the average time for 1 bit conversion is 1.875 $\mu$s. For this reason, the quartz oscillator of 500 KHz and IC 7400 are used to bring about the time required for the AD7574 conversion data. The clock generator circuit is shown in FIG. 32.

The digital alarm device was used for testing in a site as shown in FIG. 33. The test results are shown in FIGS. 34 and 35. In FIGS. 34 and 35, the circuit is mounted on the highest end of the suspension arm of the crane. The negative feedback resistance $R_2$ is 30 MΩ. In FIG. 34, the vertical height of the set-up points is 9.3 meters, whereas the horizontal distances (X) from R phase are 1 meter (set-up voltage of 6.59V), 2 meters (set-up voltage of 3.13V), and 3 meters (set-up voltage of 2.62V). In FIG. 35, the vertical height of the set-up points is 9.3 meters, whereas the horizontal distances (X) from R phase are respectively 0.5 meter (set-up voltage of 8.7V), 1.5 meters (set-up voltage of 5.54V), and 2.5 meters (set-up voltage of 3.08V).

As shown in FIGS. 34 and 35, the setting point falls within the alarm range (within 15 cm) and thus the setting function is excellent. These alarm range profiles are similar to those of FIGS. 16–18. However, the amplifying rate of the operational amplifier used in this experiment was poorer, so that the negative feedback resistance had to be twice that the used in the previous test (A) to have an appropriate setting voltage. Even if the poorer operational amplifier was used, the digital alarm device of the present invention was capable of excellent warning effect as long as the negative feedback resistance value was appropriately adjusted. In addition, Table 7 shows the relationship between the set-up positions and the set-up voltages when the set-up positions were taken right under the outermost phase conductor (R phase) by using different negative feedback resistance values (30 MΩ and 20 MΩ). These test results show that the alarm device may be set up right under the 11.4 KV overhead power lines to warn of danger of hitting the overhead power lines by the suspension arm of the crane in motion.

TABLE 7

Relationship between set-up positions and set-up voltages when the set-up positions were taken right under the outermost phase conductor (R phase) by using different negative feedback resistance values (30MΩ and 20MΩ) of the digital alarm device

| Negative feedback resistance R2 = 30MΩ | | Negative feedback resistance R2 = 20MΩ | |
|---|---|---|---|
| Vertical distance (m) | Set-up voltage (V) | Vertical distance (m) | Set-up voltage (V) |
| 2.5 | 0.662 | 2.5 | 0.464 |
| 2 | 1.677 | 2 | 0.86 |
| 1.5 | 2.928 | 1.5 | 1.13 |
| 1 | 5.81 | 1 | 2.23 |
| 0.5 | 8.81 | 0.5 | 4.43 |

FIG. 36 shows the relative positions of the crane and the 11.4 KV power distribution lines, in which the alarm device is provided with 15 and 22 MΩ negative feedback resistance for obtaining the appropriate relationship between the set-up voltages and the alarm ranges. During the test, the alarm devices were located at four different positions: front surface of the top of the suspension arm, side surface of the top of the suspension arm, the side surface at the top of the second segment of the suspension arm, and on the hook. The test results are presented as follows:

FIGS. 37 and 38 are respectively the alarm ranges under the 11.4 KV power distribution lines by using 15 MΩ and 22 MΩ as the negative feedback resistance. The alarm device was mounted on the front surface of the top end of the suspension arm, and the vertical height of the set-up points was 8.4 meters. In addition, the 20-ton crane had a huge body and a suspension arm which was unable to approach the alarm range at an angle perpendicular to the power distribution lines. As a result, it had to approach the power lines in a manner shown in FIG. 36, so as to prevent it from obstructing the traffic. On the basis of these results, it was readily apparent that the set-up points were all within the alarm range.

The alarm device was mounted on the side surface of the top end of the suspension arm, with 15 MΩ being the negative feedback resistance for measuring the alarm range, which is shown in FIG. 39. The alarm effect is similar to the alarm effect of the alarm device which was mounted on the front surface of the top end of the suspension arm, with the difference being that the set-up voltage value of the side surface is greater than the set-up voltage value of the front surface in light of the side surface of the suspension arm being closer to the electric field brought about by the power distribution lines.

FIG. 40 shows 15 MΩ being used as the negative feedback resistance. The alarm device was mounted on the side surface at the top end of the second segment of the suspension arm. The leather rule and the plummet for use in the coordinate of the horizontal distance (X) and the vertical height (Y) were moved to the alarm range measured by the second segment of the suspension arm. It can be seen from the drawing that the alarm range is higher than the power distribution lines, the reason being that the metal structure of the first segment of the suspension arm causes the change in the electric field brought about by the power distribution lines.

In addition to the suspension arm, the hook of the suspension arm can hit the high voltage power lines. In FIG. 41, 15 MΩ is used as the negative feedback resistance. The alarm device was mounted on the hook (the vertical height of the distance between the hook and the highest end of the suspension arm was 1.5 meters.) The alarm range was so measured.

In FIG. 42, 15 MΩ was used as the negative feedback resistance, when the digital alarm device was not set up for measuring the alarm range. From the drawing, it is apparent that the alarm device was capable of effecting the warning even if the operator had forgotten to do the warn range setting. The warn range is about 0.7 m when the negative feedback resistance is 15 MΩ.

The digital alarm device was disposed on the site of FIG. 25 for testing. The result is shown in FIG. 43 in which the negative feedback resistance is 1 MΩ. The set-up points were located 3 m and 4 m right under T phase of the 69 KV power transmission lines for measuring the alarm ranges. The results show that the alarm ranges are similar to the alarm range of FIG. 27. When the negative feedback resistance values are respectively 1 MΩ, 2 MΩ, 3 MΩ, 4 MΩ, the alarm ranges obtained at various set-up points are shown in FIGS. 44–47. On the basis of the drawings, the warning characteristic of the digital alarm device located right under the power transmission lines can be readily seen.

FIG. 48 shows relationship between the set-up voltage and the vertical distance under the 69 KV overhead power lines, with the negative feedback resistance value being 1 MΩ. From this curve, we can see that the distance is inversely proportional to the set-up voltage.

(D) Electromagnetic Interference (EMI) Test

In the practical application, the digital alarm device might be erroneously activated by the high frequency energy signal brought about by the surrounding environment. In order to cope with this situation, the electromagnetic interference test was done to observe the interference in the alarm device caused by high frequency energy aimed directly at the alarm device. The surrounding environment was emulated by the electromagnetic wave energy signal ranging between 26 MHz and 3 GHz. The high frequency signal was generated by the network analyzer of a Hewlett Packard Co., Product No. 85046A S-Parameter test set. The alarm device was aimed at from the distance of 1 m using 25 dBm energy generated by the network analyzer via an antenna. The antenna may be of two forms, with one of them being the double ridged waveguide horn antenna (EMCO Model 3115) having an emitting frequency range between 1 GHz and 18 GHz, and with the other one being a log-periodic/bow-tie antenna (EMCO Model 3142) having an emitting frequency range between 26 MHz and 2 GHz.

When the set-up of the alarm device is completed, the alarm device is adjusted such that the alarm device is kept in the critical state of transmitting the warning signal. The high frequency electromagnetic wave is aimed at the alarm device and emitted from the distance of lm. According to the experimental results, the digital alarm device does not bring about the false alarm, due to the interference caused by the high frequency electromagnetic wave. In the experiment, we kept adjusting various angles of the digital alarm device, and the alarm device did not bring about the false alarm either.

What is claimed is:

1. An alarm device designed to warn of danger of hitting high voltage overhead power lines by a crane in motion, said alarm device comprising:

an electric-field sensor for detecting an alternating electric field of high voltage power lines, and for outputting an alternating current;

an amplifier connected with said electric-field sensor for converting or amplifying the alternating current, and for outputting an alternating voltage;

a rectifier/filter circuit connected with said amplifier for rectifying and filtering the alternating voltage, and for outputting a direct current voltage;

a wireless transmitter;

a starter unit disposed between said rectifier/filter circuit and said wireless transmitter for starting said wireless transmitter to transmit a wireless signal at such time when the direct current voltage exceeds a predetermined value; and a wireless receiver/alarm for receiving the wireless signal transmitted by said wireless transmitter and for bringing about a warning signal, wherein said starter unit comprises a memory capacitor or a digital memory unit circuit for storing a preset voltage, and a comparator for comparing the direct current voltage with the preset voltage.

2. The alarm device as defined in claim 1, wherein said electric-field sensor is an electric-field plate or a plurality of electric-field plates parallel to one another.

3. The alarm device as defined in claim 1, wherein said starter unit comprises a transistor.

4. The alarm device as defined in claim 1 further comprising a receiver for remotely setting said memory capacitor or digital memory unit circuit, and a relay, wherein said memory capacitor or digital memory unit circuit is connected to said rectifier/filter circuit by said relay at the time when said receiver receives a remote set-up signal such that the direct current voltage outputted by said rectifier/filter circuit at the time is sent to said memory capacitor or said digital memory unit circuit in which the direct current voltage is stored as the preset voltage.

* * * * *